US008257062B2

(12) United States Patent
Isono

(10) Patent No.: US 8,257,062 B2
(45) Date of Patent: Sep. 4, 2012

(54) ELECTRIC THRUST PISTON PUMP DEVICE

(75) Inventor: Hiroshi Isono, Mishima (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 957 days.

(21) Appl. No.: 12/299,476

(22) PCT Filed: Jan. 25, 2008

(86) PCT No.: PCT/JP2008/051607

§ 371 (c)(1),
(2), (4) Date: Nov. 4, 2008

(87) PCT Pub. No.: WO2008/111339

PCT Pub. Date: Sep. 18, 2008

(65) Prior Publication Data

US 2009/0092508 A1 Apr. 9, 2009

(30) Foreign Application Priority Data

Mar. 9, 2007 (JP) ..... 2007-59729
Mar. 9, 2007 (JP) ..... 2007-59730

(51) Int. Cl.
*F04B 35/04* (2006.01)

(52) U.S. Cl. ..... 417/415; 417/356; 417/460

(58) Field of Classification Search ..... 417/356, 417/460, 462, 487, 490

See application file for complete search history.

(56) References Cited

U.S. PATENT DOCUMENTS 2,401,466 A 6/1946 Davis et al.
2,415,618 A 2/1947 West
2,855,176 A 10/1958 Boteler
3,285,192 A 11/1966 Gutkowski
3,477,345 A 11/1969 Johnson (Continued)

FOREIGN PATENT DOCUMENTS

CN 2660164 Y 12/2004

(Continued)

OTHER PUBLICATIONS

Extended European Search Report issued Feb. 16, 2011, in Application No. / Patent No. 08704316.2-2315 / 2123919 PCT/JP2008051607.

(Continued)

*Primary Examiner* — Tracie Y Green
(74) *Attorney, Agent, or Firm* — Oblon, Spivak, McClelland, Maier & Neustadt, L.L.P.

(57) ABSTRACT

A thrust piston pump apparatus PM1 can be driven by an electric motor 110 and is provided with a pump housing 120, a reciprocating piston 130 assembled into the pump housing 120, and a motion conversion mechanism 40 provided between the reciprocating piston 130 and a rotor 113 of the electric motor 110. In the electric motor 110, a tubular rotor 113 is disposed in a stator (magnet 112), and a cylinder portion 121A of the pump housing 120 is coaxially housed in the rotor 113. The reciprocating piston 130 is assembled into the cylinder portion 121A of the pump housing 120 in such a manner as to be able to reciprocate along a cylinder axis. The motion conversion mechanism 140 converts a rotary motion of the rotor 113 of the electric motor 110 in relation to the pump housing 120 and the reciprocating piston 130 to a reciprocating motion of the reciprocating piston 130.

16 Claims, 9 Drawing Sheets

U.S. PATENT DOCUMENTS

| | | | | |
|---|---|---|---|---|
| 3,496,875 | A * | 2/1970 | Van Allen et al. | 60/543 |
| 4,385,870 | A * | 5/1983 | Merz | 417/273 |
| 4,553,506 | A | 11/1985 | Bekiaroglou | |
| 5,667,606 | A | 9/1997 | Renier | |
| 5,947,696 | A | 9/1999 | Baumgarten | |
| 6,505,590 | B1 | 1/2003 | Rao et al. | |
| 6,601,548 | B2 * | 8/2003 | Al-Hawaj | 123/56.1 |
| 6,672,684 | B2 | 1/2004 | Mohr | |
| 2008/0003110 | A1 | 1/2008 | Isono | |
| 2008/0251335 | A1 * | 10/2008 | Reiner et al. | 188/358 |

FOREIGN PATENT DOCUMENTS

| | | |
|---|---|---|
| CN | 1228547 C | 11/2005 |
| FR | 2 822 195 | 9/2002 |
| JP | 45-20471 | 7/1970 |
| JP | 49 63877 | 6/1974 |
| JP | 50-148912 | 11/1975 |
| JP | 6-205563 | 7/1994 |
| JP | 8 144948 | 6/1996 |
| JP | 11-22638 | 1/1999 |
| JP | 2004 278363 | 10/2004 |
| JP | 2006 283823 | 10/2006 |
| JP | 2007 39013 | 2/2007 |
| KR | 2001-0054503 | 7/2001 |
| WO | WO 97/02961 | 1/1997 |
| WO | 2006 107064 | 10/2006 |

OTHER PUBLICATIONS

Office Action issued on Jun. 22, 2011 in the corresponding Chinese Application No. 200880000552.5 (with Partial English Translation).

Office Action issued Jun. 12, 2010 in Chinese Application No. 2008800005525 (With English Translation).

* cited by examiner

ELECTRIC THRUST PISTON PUMP DEVICE

TECHNICAL FIELD

The present invention relates to a thrust piston pump apparatus, and more particularly to a motor-driven thrust piston pump apparatus configured such that a rotary motion of an electric motor is converted to a reciprocating motion of a piston (thrust piston), whereby the reciprocating motion of the piston provides a pumping operation.

BACKGROUND ART

A thrust piston pump apparatus of this kind is disclosed in, for example, Japanese Patent Application Laid-Open (kokai) No. 8-144948. In the thrust piston pump apparatus disclosed in the publication, a piston is assembled into a cylinder in such a manner as to be rotatable and to be able to reciprocate along a cylinder axis. The piston is configured to be driven by an electric motor. A rotary shaft, which is rotatably driven by the electric motor, is inserted into the piston in such a manner as to transmit rotation to the piston while allowing the piston to move axially.

In the thrust piston pump apparatus described in the above-mentioned publication, the piston and the electric motor are arranged in series along the cylinder axis. Thus, the thrust piston pump apparatus has a long configuration along the cylinder axis. A problem to tackle for the thrust piston pump apparatus is to reduce the length along the cylinder axis. The thrust piston pump apparatus can generate a high output in relation to pump volume by means of increasing an output torque of the electric motor. However, in this case, the outside diameter of the electric motor increases; consequently, the size of the pump also increases radially. Therefore, a large installation space is required.

DISCLOSURE OF THE INVENTION

The present invention has been conceived for coping with the above-mentioned problems and provides a motor-driven thrust piston pump apparatus configured such that a tubular rotor is disposed in a stator of an electric motor, a cylinder portion of a pump housing is coaxially housed in the rotor, and a reciprocating piston is assembled into a cylinder bore of the cylinder portion in such a manner as to be able to reciprocate along a cylinder axis and define a pump chamber in the cylinder bore, wherein the pump housing includes a suction passage for allowing a fluid to be taken therethrough into the pump chamber and a discharge passage for allowing the fluid to be discharged therethrough from the pump chamber, and a motion conversion mechanism is provided between the reciprocating piston and the rotor so as to convert a rotary motion of the rotor to a reciprocating motion of the reciprocating piston.

In the thrust piston pump apparatus, the rotor of the electric motor assumes a tubular form, and the cylinder portion (into which the reciprocating piston is assembled in such a manner as to be able to reciprocate along the cylinder axis) of the pump housing is coaxially housed in the rotor. Thus, the rotor of the electric motor, the cylinder portion of the pump housing, and the reciprocating piston can be disposed concentrically, so that the pump apparatus can be configured to be short along the cylinder axis.

Also, in the thrust piston pump apparatus, the cylinder portion of the pump housing and the reciprocating piston are disposed concentrically within the rotor of the electric motor. This inevitably increases the rotor diameter of the electric motor and thus inevitably implements a high output torque of the electric motor. Therefore, the present invention can implement compactness of the pump apparatus through reduction in length along the cylinder axis, and high output of the pump apparatus through implementation of high output torque of the electric motor.

The present invention can be carried out as follows: the motion conversion mechanism is a cam mechanism provided with a cam which rotates unitarily with the rotor and which has a cam groove formed along its inner circumference, and a cam follower which is assembled to the reciprocating piston and engaged with the cam groove and which moves unitarily with the reciprocating piston along the cylinder axis. Also, the present invention can be carried out as follows: the pump housing has a flange portion whose one side closes a motor housing of the electric motor, and an accumulator for accumulating the fluid discharged through the reciprocating motion of the reciprocating piston is attached to the other side of the flange portion. In this case, low cost and compactness can be achieved.

Also, the present invention can be carried out as follows: the motion conversion mechanism is provided with a cam which is unitarily provided on the rotor, and a cam follower which is assembled to the reciprocating piston in such a manner as to be radially movable in relation to the reciprocating piston and to be movable along the cylinder axis unitarily with the reciprocating piston; which is movable along the cylinder axis and nonrotatable in relation to the cylinder portion; and which is engaged with the cam; and a passage for leading a fluid pressure of the pump chamber toward the cam follower so as to press the cam follower against the cam is provided in the reciprocating piston.

In this case, since the fluid pressure of the pump chamber is led toward the cam follower through the passage provided in the reciprocating piston, the fluid pressure of the pump chamber can press the cam follower against the cam. Thus, irrespective of discharge pressure of the pump apparatus, the cam follower can be appropriately (under high pressure when the discharge pressure is high, or under low pressure when the discharge pressure is low) pressed against the cam, whereby pump efficiency can be improved. Further, any possible play between the cam follower and the cam can be restrained by a simple configuration (by means of the passage provided in the reciprocating piston).

During reciprocation of the reciprocating piston along the cylinder axis, even when the cam follower is pressed back from the cam in a radial direction of the reciprocating piston, the cam follower exhibits a pumping function in the radial direction of the reciprocating piston (the cam follower presses back the fluid, which is led from the pump chamber toward the cam follower through the passage, toward the pump chamber), thereby restraining drop in pump efficiency.

Also, the present invention can be carried out as follows: the cam is a bevel-faced cam inclined by a predetermined amount with respect to the cylinder axis, and a working force along the cylinder axis which is induced by a radial load exerted on the cam follower by the fluid pressure of the pump chamber is set equal to or greater than a load along the cylinder axis which is exerted on the reciprocating piston by the fluid pressure of the pump chamber.

In this case, at any fluid pressure of the pump chamber, the cam follower is not pressed back from the cam in a radial direction of the reciprocating piston, and the cam follower can be appropriately pressed against the cam, so that any possible play between the cam follower and the cam can be appropriately reduced. As compared with the case where a radial load exerted on the cam follower is proportional to the fluid pressure of the pump chamber, and the cam follower is pressed against the cam by means of a spring (in this case, in order to appropriately press the cam follower against the cam at any fluid pressure of the pump chamber, the spring force of the spring must be set large; thus, friction loss between the cam follower and the cam is high at all times), friction loss between the cam follower and the cam can be lowered, thereby restraining drop in pump efficiency, which could otherwise result from the friction loss.

Also, the present invention can be carried out as follows: the cam follower is provided with a load transmission piston assembled to the reciprocating piston, and a rolling element rollably assembled to a distal end portion of the load transmission piston and engaged with the cam, and a communication bore for leading the fluid pressure of the pump chamber toward a rolling-element support portion of the load transmission piston is provided in the load transmission piston. In this case, since the fluid pressure of the pump chamber is led toward the rolling-element support portion of the load transmission piston through the communication bore provided in the load transmission piston, a contact load between the rolling element and the load transmission piston can be reduced. Thus, sliding resistance and the amount of wear between the rolling element and the load transmission piston can be reduced.

In this case, the following configuration can also be possible: a taper face for rollably supporting the rolling element is formed at the distal end portion of the load transmission piston, and an orifice is provided in the communication bore provided in the load transmission piston. In this case, by means of imparting a large diameter to the taper face, a contact load between the rolling element and the load transmission piston can be reduced. Also, by means of employing a small orifice diameter, the amount of leakage of fluid to the low-pressure side from between the rolling element and the load transmission piston can be reduced. Thus, compatibility between the reductions can be attained.

Also, in this case, the following configuration can also be possible: a pressure-receiving area of the rolling element subjected to the fluid pressure led through the communication bore provided in the load transmission piston is set slightly smaller than a pressure-receiving area of the load transmission piston subjected to the fluid pressure led through the passage provided in the reciprocating piston. In this case, a contact load between the rolling element and the load transmission piston can be reduced (a load for providing a seal between the rolling element and the load transmission piston can be made to approach zero). Thus, friction between the rolling element and the load transmission piston can be reduced, so that wear resistance can be improved.

Also, the present invention can be carried out as follows: the cylinder bore of the cylinder portion is composed of a first cylinder bore and a second cylinder bore which are coaxially aligned and are a predetermined distance apart from each other along the cylinder axis, and the reciprocating piston is integrally provided with a first piston portion which is fitted into the first cylinder bore to thereby define a first pump chamber and with a second piston portion which is fitted into the second cylinder bore to thereby define a second pump chamber.

In this case, since the reciprocating piston is integrally provided with the first piston portion and the second piston portion, the pump apparatus can be rendered compact. Also, since the first cylinder bore and the second cylinder bore are coaxially aligned and are a predetermined distance apart from each other along the cylinder axis, a guide length (support span) for the reciprocating piston can be rendered long. Thus, prying force between the reciprocating piston and the pump housing can be restrained, thereby reducing a mechanical loss which occurs in the pump apparatus due to the prying force.

In this case, the following configuration can also be possible: a housing bore having a diameter greater than an outside diameter of the reciprocating piston is formed in the cylinder portion between the first cylinder bore and the second cylinder bore; a chamber is formed between the housing bore and the reciprocating piston; the chamber and the first pump chamber are connected through a first suction passage; and the chamber and the second pump chamber are connected through a second suction passage. In this case, since the chamber can be used in common, there is no need to prepare separate suction ports for the two pump chambers, respectively. That is, a suction channel of the pump apparatus can be simply configured by means of establishing communication between a single suction port and the chamber.

Also, in this case, the following configuration can also be possible: the cam follower is composed of a first cam follower which is pressed against the cam under the fluid pressure of the first pump chamber, and a second cam follower which is pressed against the cam under the fluid pressure of the second pump chamber. In this case, the first and second cam followers can be optimally pressed against the cam, whereby friction loss and wear, which are useless, can be reduced.

Also, in this case, the following configuration can also be possible: the cam follower is composed of a first cam follower and a second cam follower which are coaxially aligned and are pressed against the cam, and a changeover valve for leading the fluid pressure of the first pump chamber or the fluid pressure of the second pump chamber, whichever is higher, to the first cam follower and to the second cam follower is provided in the reciprocating piston. This can prevent the fluid pressure of the first pump chamber or the fluid pressure of the second pump chamber, whichever is lower, from being led to the first cam follower and to the second cam follower. Thus, the first cam follower and the second cam follower become unlikely to be pressed back from the cam in a radial direction of the reciprocating piston, whereby suction efficiency in the first and second pump chambers can be improved.

In this case, the following configuration can also be possible: the changeover valve is provided with a valve plug which is placed between and coaxially aligned with the first cam follower and the second cam follower in an axially movable manner, and a pair of valve seats being formed on the first cam follower and the second cam follower, respectively, and allowing the valve plug to be seated thereon and to depart therefrom. In this case, through effective utilization of the first cam follower and the second cam follower, the changeover valve can be simply configured.

Also, in this case, the following configuration can also be possible: the changeover valve is composed of a first check valve disposed in a first passage provided in the reciprocating piston and communicating with the first pump chamber, and adapted to prevent flow to the first pump chamber, and a second check valve disposed in a second passage provided in the reciprocating piston and communicating with the second pump chamber, and adapted to prevent flow to the second pump chamber. In this case, a pressure chamber formed between the first cam follower and the second cam follower can be of a small size, so that a sufficiently long guide length can be secured for each of the first and second cam followers.

In this case, the following configuration can also be possible: the check valves are disposed such that, at the end of a discharge stroke in each of the pump chambers, the valve plug of the check valve corresponding to the pump chamber in the discharge stroke is closingly seated by itself by the effect of acceleration of a reciprocating motion of the reciprocating piston. In this case, each of the check valves can be a check valve which is not provided with a spring for urging its valve plug (e.g., a ball) toward its valve seat (a so-called ball-free-type check valve); thus, the present invention can be carried out inexpensively. Also, at the end of a discharge stroke in each of the pump chambers, the valve plug of the check valve corresponding to the pump chamber in the discharge stroke is closingly seated by itself; i.e., before start of a suction stroke in each of the pump chambers, the check valve corresponding to the pump chamber which is to start the suction stroke is closed. Therefore, when a suction stroke starts in each of the pump chambers, fluid does not flow into the pump chamber which starts the suction stroke, through the check valve corresponding to the pump chamber in the suction stroke, whereby suction efficiency in the pump chambers can be improved.

BEST MODE FOR CARRYING OUT THE INVENTION

Figure 1:
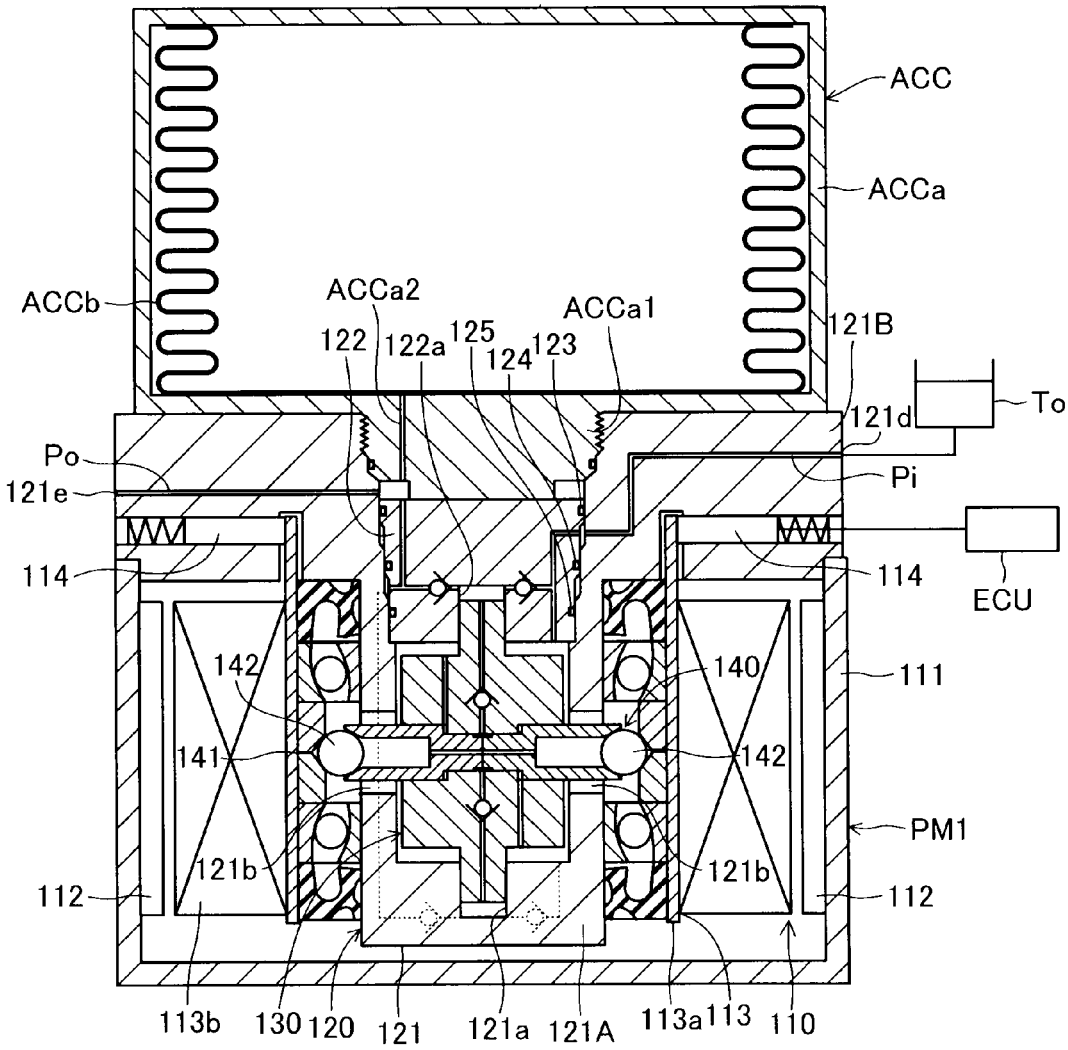
FIG. 1 is an overall, configurational view schematically showing a first embodiment of a motor-driven thrust piston pump apparatus according to the present invention.
Figure 2:
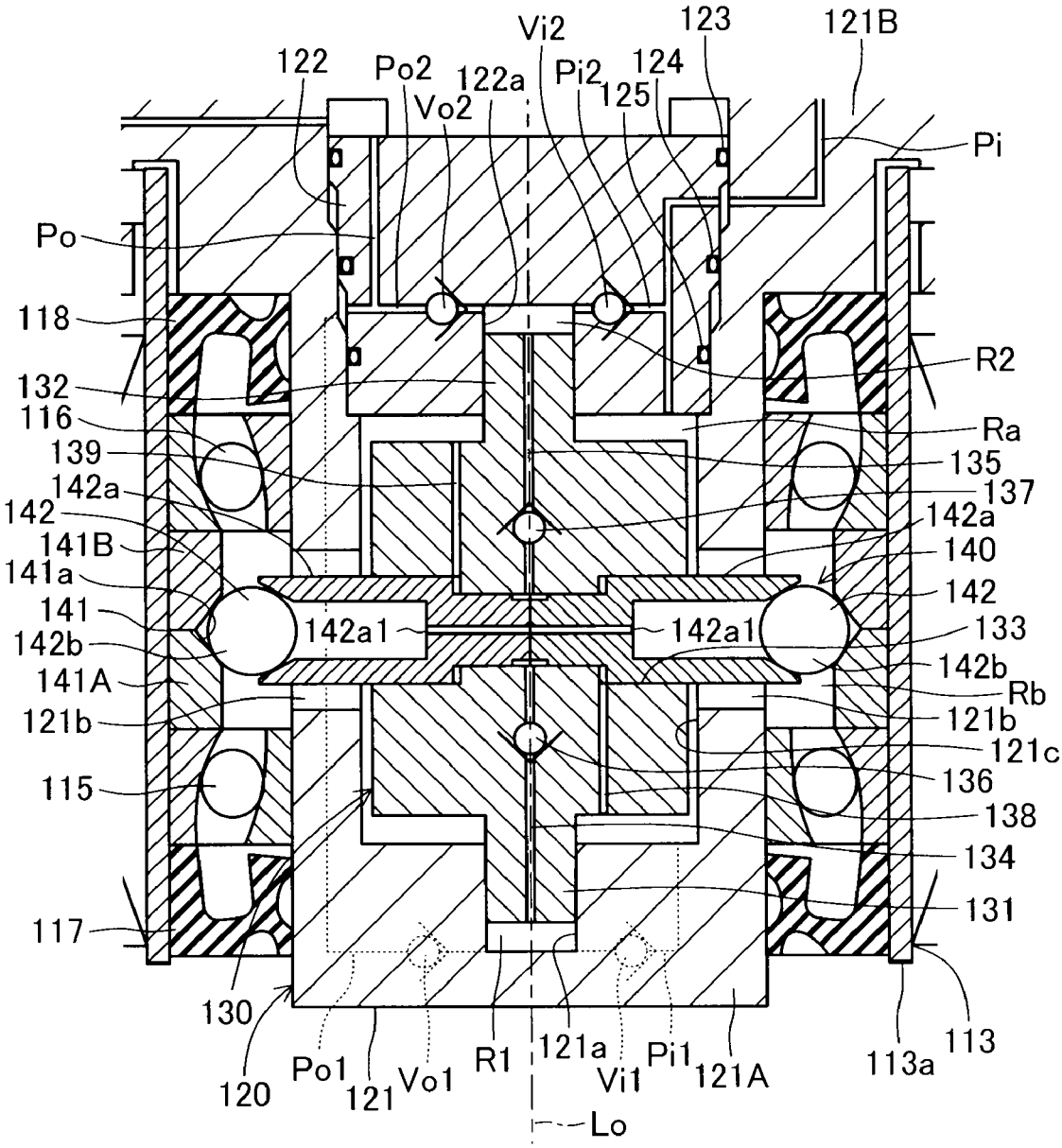
FIG. 2 is an enlarged view of essential portions of the thrust piston pump apparatus shown in FIG. 1.

Embodiments of the present invention will next be described with reference to the drawings. FIGS. 1 and 2 show a first embodiment of a motor-driven thrust piston pump apparatus according to the present invention. A pump apparatus PM1 of the first embodiment can be driven by an electric motor 110. An accumulator ACC is unitarily attached to the pump apparatus PM1 of the first embodiment, whereby a pressure fluid (pressure oil) discharged from the pump apparatus PM1 can be accumulated in the accumulator ACC.

The pump apparatus PM1 is provided with a pump housing 120, a reciprocating piston 130 assembled into the pump housing 120, and a motion conversion mechanism 140 composed of a cam member 141 and a pair of cam followers 142 and adapted to convert a rotary motion of a rotor 113 of the electric motor 110 in relation to the pump housing 120 and the reciprocating piston 130 to a reciprocating motion of the reciprocating piston 130. Also, the pump apparatus PM1 is provided with a suction passage Pi and a discharge passage Po.

As shown in FIG. 1, the electric motor 110 is provided with a closed-bottomed tubular motor housing 111, a magnet 112 provided in the motor housing 111 and serving as a stator, the tubular rotor 113 concentrically disposed in the magnet 112, a brush 114 for energizing a coil 113*b* attached onto a cylindrical member 113*a* of the rotor 113, etc. The electric motor 110 is configured such that its operation is controlled by an electric control unit ECU. The structure of the electric motor 110 is not limited to the above-mentioned structure, but various other structures can be employed.

The cylindrical member 113*a* of the rotor 113 is coaxially disposed around the outer circumference of a cylindrical cylinder portion 121A of the pump housing 120 and is assembled to the pump housing 120 via a pair of bearings 115 and 116 and a pair of annular seal members 117 and 118 in a liquid-tight condition and in such a manner as to be rotatable about an axis Lo in relation to the pump housing 120. The paired bearings 115 and 116 are axially disposed a predetermined distance apart from each other; intervene between the pump housing 120 and the cylindrical member 113*a* of the rotor 113 in such a manner as to axially hold the cam member 141 therebetween; and enable the cylindrical member 113*a* to rotate in relation to the pump housing 120.

The paired annular seal members 117 and 118 are axially disposed a predetermined distance apart from each other; intervene between the pump housing 120 and the cylindrical member 113*a* in such a manner as to axially hold the cam member 141 and the bearings 115 and 116 therebetween; and provide a liquid-tight seal between the pump housing 120 and the cylindrical member 113*a*. An outer chamber Rb formed between the pump housing 120 and the cylindrical member 113*a* and accommodating the bearings 115 and 116, the cam member 141, etc. communicates with an inner chamber Ra formed between the pump housing 120 and the reciprocating piston 130, through a pair of axially elongated holes 121*b* provided in the pump housing 120. The chambers Ra and Rb are filled with fluid (working oil).

The pump housing 120 is composed of a housing body 121 having the closed-bottomed cylinder portion 121A and an annular flange portion 121B, and a plug 122 attached to the interior of the cylinder portion 121A of the housing body 121. The cylinder portion 121A of the housing body 121 has a first cylinder bore 121*a*, the paired axially elongated holes 121*b*, and a housing bore 121*c* having a diameter greater than the outside diameter of the reciprocating piston 130, and is coaxially housed in the rotor 113 of the electric motor 110. The paired axially elongated holes 121*b* collectively serve as guide means for guiding the reciprocating piston 130 and the paired cam followers 142 in such a manner that the reciprocating piston 130 and the paired cam followers 142 can reciprocate along a cylinder axis (the vertical direction in the drawings). The paired axially elongated holes 121*b* are formed 180 degrees apart from each other in the circumferential direction of the pump housing 120.

The annular flange portion 121B of the housing body 121 is provided integrally with an open-end portion (upper end portion in the drawings) of the cylinder portion 121A. The annular flange portion 121B is attached, at its one side (lower side in the drawings), to the motor housing 111 of the electric motor 110, thereby closing an opening portion of the motor housing 111. The annular flange portion 121B of the housing body 121 has a single suction port 121*d* and a single discharge port 121*e*. A reservoir To is connected to the suction port 121*d*, and hydraulically actuated equipment (not shown) is connected to the discharge port 121*e*.

The plug 122 has a second cylinder bore 122*a*, which is coaxially aligned with and a predetermined distance apart from the above-mentioned first cylinder bore 121*a* along the cylinder axis. The plug 122 is fluid-tightly and coaxially fitted into a stepped bore of the cylinder portion 121A of the housing body 121 via three seal rings; namely, a large seal ring 123, a medium seal ring 124, and a small seal ring 125. Detachment of the plug 122 is prevented by means of a plug portion ACCa1 of a casing ACCa of the accumulator ACC. The second cylinder bore 122*a* of the plug 122 has the same diameter as that of the first cylinder bore 121*a* of the housing body 121.

The reciprocating piston 130 has a diametrally small first piston portion 131, which is fitted into the first cylinder bore 121*a* in such a manner as to be slidable along the cylinder axis and defines a first pump chamber R1, and a diametrally small second piston portion 132, which is fitted into the second cylinder bore 122*a* in such a manner as to be slidable along the cylinder axis and defines a second pump chamber R2. The reciprocating piston 130 is disposed coaxially with the cylinder bores 121*a* and 122*a* and is assembled into the cylinder portion 121A of the pump housing 120 in such a manner as to be able to reciprocate along the cylinder axis. The first piston portion 131 and the second piston portion 132 have the same diameter (the same area subjected to the fluid pressure of the pump chambers R1 and R2, respectively).

A stepped bore 133 is formed in a central region of a diametrally large shaft portion of the reciprocating piston 130 such that its opposite end portions have a large diameter, while its intermediate portion has a small diameter, and in such a manner as to extend through the diametrally large shaft portion in a radial direction of the reciprocating piston 130 (in the horizontal direction in the drawings). The paired cam followers 142 are coaxially assembled into the stepped bore 133. A first passage 134 is formed in an axially core portion of the reciprocating piston 130 for leading the fluid pressure (oil pressure) of the first pump chamber R1 toward the cam followers 142 so as to press the cam followers 142 against the cam member 141. Also, a second passage 135 is formed in the axially core portion of the reciprocating piston 130 for leading the fluid pressure (oil pressure) of the second pump chamber R2 toward the cam followers 142 so as to press the cam followers 142 against the cam member 141.

The first passage 134 is rectilinearly formed along the cylinder axis and communicates with the first pump chamber R1 at its one end and with an intermediate portion (diametrally small bore portion) of the stepped bore 133 at its other end. The first passage 134 can introduce the fluid pressure (oil pressure) of the first pump chamber R1 into a pressure chamber formed between the two cam followers 142. A first check valve 136 is disposed in the first passage 134 for preventing flow to the first pump chamber R1. The first check valve 136 is disposed such that, at the end of a discharge stroke in the first pump chamber R1, its valve plug (ball) is closingly seated by itself by the effect of acceleration of a reciprocating motion of the reciprocating piston 130.

The second passage 135 is rectilinearly formed along the cylinder axis and communicates with the second pump chamber R2 at its one end and with the intermediate portion (diametrally small bore portion) of the stepped bore 133 at its other end. The second passage 135 can introduce the fluid pressure (oil pressure) of the second pump chamber R2 into the pressure chamber formed between the two cam followers 142. A second check valve 137 is disposed in the second passage 135 for preventing flow to the second pump chamber R2. The second check valve 137 is disposed such that, at the end of a discharge stroke in the second pump chamber R2, its valve plug (ball) is closingly seated by itself by the effect of acceleration of a reciprocating motion of the reciprocating piston 130.

Communication bores 138 and 139 are formed in the diametrally large shaft portion of the reciprocating piston 130 along the cylinder axis for freely supplying fluid to and draining fluid from respective stepped portions of the stepped bore 133. The communication bore 138 communicates with one stepped portion of the stepped bore 133 and also communicates with the inner chamber Ra formed between the reciprocating piston 130 and the housing bore 121*c* formed in the pump housing 120. The other communication bore 139 communicates with the other stepped portion of the stepped bore 133 and also communicates with the above-mentioned inner chamber Ra. The inner chamber Ra communicates with the reservoir To through the suction passage Pi and is filled with fluid (working oil).

The cam member 141 is composed of a pair of cam sleeves 141A and 141B provided in contact with each other along the cylinder axis; is provided in such a manner as to be unitary with the rotor 113 of the electric motor 110 (in such a manner as to be axially immovable and to be rotatable with the rotor 113); and is disposed coaxially with the rotor 113. The cam member 141 has an annular cam portion 141*a* whose axial position circumferentially varies; the cam portion 141*a* is a cam groove; and balls 142*b* of the cam followers 142 are engaged with the cam groove.

The cam groove 141*a* has cam faces (bevel-faced cams inclined by a predetermined amount with respect to the cylinder axis) which receive an axial load (a load along the vertical direction in the drawings) and a radial load (a load along the horizontal direction in the drawings) from the balls 142*b* of the cam followers 142. The cam faces form a V-shaped cross section and have an even number of geometric cycles (e.g., two geometric cycles) along the circumferential direction of the rotor 113. Accordingly, when the rotor 113 makes one revolution in relation to the pump housing 120 and the reciprocating piston 130, the cam member 141 can cause the reciprocating piston 130 to reciprocate an even number of times.

The cam followers 142 are provided with respective load transmission pistons 142*a* assembled to the reciprocating piston 130, and the respective balls (rolling elements) 142*b* rollably assembled to distal end portions of the respective load transmission pistons 142*a* and rollably engaged with the cam portion 141*a* of the cam member 141. The cam followers 142 are engaged with the cam portion (cam groove) 141*a* at their end portions extending in a radial direction perpendicular to the axis Lo; i.e., at the balls 142*b*, and rotate in relation to the cam member 141 to thereby move along the cylinder axis (vertically in the drawings).

The load transmission pistons 142*a* are formed into stepped shapes, respectively; their end portions on a side toward the balls (diametrally large portions) are formed into cup shapes, respectively; and taper faces (ball support portions) are formed at their respective distal end portions and support the respective balls 142*b* in such a manner that the balls 142*b* are rollable. Diametrally small communication bores (orifices) 142*a*1 are provided in axially core portions of the respective load transmission pistons 142*a* and are adapted to lead the fluid pressure of each of the pump chambers R1 and R2 toward the ball support portions of the load transmission pistons 142*a*. In each of the load transmission pistons 142*a*, a pressure-receiving area S2 of the ball 142*b* subjected to fluid pressure led through the diametrally small communication bore (orifice) 142*a*1 provided in the load transmission piston 142*a* is set slightly smaller than a pressure-receiving area S1 of a diametrally small portion subjected to fluid pressure led through the passages 134 and 135 provided in the reciprocating piston 130 (S1>S2 and S1−S2≅0).

The suction passage Pi includes a main suction passage connecting the reservoir To and the inner chamber Ra; a branch suction passage connecting the inner chamber Ra and the first pump chamber R1; namely, a first suction passage Pi1; and a branch suction passage connecting the inner chamber Ra and the second pump chamber R2; namely, a second suction passage Pi2. A first suction check valve V11 is disposed in the first suction passage Pi1. Fluid (working oil) can be sucked into the first pump chamber R1 through the first suction check valve V11. A second suction check valve Vi2 is disposed in the second suction passage Pi2. Fluid (working oil) can be sucked into the second pump chamber R2 through the second suction check valve Vi2.

The discharge passage Po includes a main discharge passage to be connected to hydraulically actuated equipment (not shown); a branch discharge passage connecting the main discharge passage and the first pump chamber R1; namely, a first discharge passage Po1; and a branch discharge passage connecting the main discharge passage and the second pump chamber R2; namely, a second discharge passage Po2. A first discharge check valve Vo1 is disposed in the first discharge passage Po1. A pressure fluid (pressure oil) can be discharged to the main discharge passage from the first pump chamber R1 through the first discharge check valve Vo1.

A second discharge check valve Vo2 is disposed in the second discharge passage Po2. A pressure fluid (pressure oil) can be discharged to the main discharge passage from the second pump chamber R2 through the second discharge check valve Vo2. As shown in FIG. 1, the pressure fluid (pressure oil) discharged to the main discharge passage can be accumulated in the accumulator ACC through a communication bore ACCa2 provided in the plug portion ACCa1 of the accumulator ACC and can be supplied toward the hydraulically actuated equipment (not shown) as well. The pressure fluid (pressure oil) supplied to the hydraulically actuated equipment (not shown) returns to the reservoir.

As shown in FIG. 1, the accumulator ACC is provided with a casing ACCa fixedly attached to the illustrated upper side of the annular flange portion 121B of the pump housing 120, and bellows ACCb assembled into the casing ACCa and defining a gas chamber therein and an accumulation chamber at the exterior thereof. The bellows ACCb is such that its lower end in FIG. 1 is closed, whereas its upper end portion in FIG. 1 is fixedly attached to the upper wall of the casing ACCa in an airtight and liquid-tight manner. A gas having a predetermined pressure is confined in the bellows ACCb; the bellows ACCb can expand and contract vertically in FIG. 1 at corrugated portions; and in a contracted state, the bellows ACCb can accumulate, in the accumulation chamber, the pressure fluid (pressure oil) discharged from the pump apparatus PM.

In the thus-configured pump apparatus PM1 of the first embodiment, when the rotor 113 is rotatably driven by the electric motor 110, the motion conversion mechanism 140 converts a rotary motion of the rotor 113 in relation to the pump housing 120 and the reciprocating piston 130 to a reciprocating motion of the reciprocating piston 130, whereby the reciprocating piston 130 performs reciprocation (pumping operation) along the cylinder axis. Accordingly, the pump chambers R1 and R2 alternately increase and decrease in volume, whereby fluid (working oil) which is sucked into the pump chamber R1 or R2 through the suction passage Pi is discharged from the pump chamber R1 or R2 toward the hydraulically actuated equipment (not shown) through the discharge passage Po and is accumulated in the accumulation chamber of the accumulator ACC as well.

Meanwhile, in the pump apparatus PM1 of the first embodiment, the rotor 113 of the electric motor 110 assumes a tubular form, and the cylinder portion 121A (into which the reciprocating piston 130 is assembled in such a manner as to be able to reciprocate along the cylinder axis) of the pump housing 120 is coaxially housed in the rotor 113. Thus, the rotor 113 of the electric motor 110, the cylinder portion 121A of the pump housing 120, and the reciprocating piston 130 can be disposed concentrically, so that the pump apparatus PM1 can be configured to be short along the cylinder axis.

Also, in the pump apparatus PM1 of the first embodiment, the cylinder portion 121A of the pump housing 120 and the reciprocating piston 130 are disposed concentrically within the rotor 113 of the electric motor 110. This inevitably increases the rotor diameter of the electric motor 110 and thus inevitably implements a high output torque of the electric motor 110. Therefore, the first embodiment can implement compactness of the pump apparatus PM1 through reduction in length along the cylinder axis, and high output of the pump apparatus PM1 through implementation of high output torque of the electric motor 110.

Also, in the first embodiment, the pump housing 120 has the flange portion 121B whose one side closes the motor housing 111 of the electric motor, and the accumulator ACC for accumulating fluid discharged through the reciprocating motion of the reciprocating piston 130 is attached to the other side of the flange portion 121B. Thus, the first embodiment can implement low cost and compactness.

Also, in the pump apparatus PM1 of the first embodiment, since the fluid pressure (oil pressure) of the pump chamber R1 and that of the pump chamber R2 are led toward the cam followers 142 through the passages 134 and 135, respectively, provided in the reciprocating piston 130, the fluid pressure (oil pressure) of the pump chamber R1 and that of the pump chamber R2 can press the respective cam followers 142 against the cam member 141. Thus, irrespective of discharge pressure of the pump apparatus PM1, the cam followers 142 can be appropriately (under high pressure when the discharge pressure is high, or under low pressure when the discharge pressure is low) pressed against the cam member 141, whereby pump efficiency can be improved. Further, any possible play between the cam followers 142 and the cam member 141 can be restrained by a simple configuration (by means of the passages 134 and 135 provided in the reciprocating piston 130).

Also, in the pump apparatus PM1 of the first embodiment, the cam followers 142 are provided with the respective load transmission pistons 142*a* assembled to the reciprocating piston 130, and the respective balls 142*b* rollably assembled to distal end portions of the respective load transmission pistons 142*a* and engaged with the cam member 141. Also, the diametrally small communication bores 142*a*1 for leading the fluid pressure (oil pressure) of the pump chamber R1 and that of the pump chamber R2 toward the ball support portions of the load transmission pistons 142*a* are provided in the respective load transmission pistons 142*a*. Thus, the fluid pressure (oil pressure) of the pump chamber R1 and that of the pump chamber R2 are led toward the ball support portions of the load transmission pistons 142*a* through the communication bores 142*a*1 provided in the respective load transmission pistons 142*a*. Therefore, a contact load between the load transmission pistons 142*a* and the associated balls 142*b* can be reduced. Thus, sliding resistance and the amount of wear between the load transmission pistons 142*a* and the associated balls 142*b* can be reduced.

Also, in the pump apparatus PM1 of the first embodiment, taper faces for rollably supporting the respective balls 142*b* are formed at the distal end portions of the respective load transmission pistons 142*a*, and the communication bores 142*a*1 provided in the respective load transmission pistons 142*a* assume a small diameter (orifice). Thus, by means of imparting a large diameter to the taper faces (by means of increasing contact area), a contact load between the load transmission pistons 142*a* and the associated balls 142*b* can be reduced. Also, by means of employing a small orifice diameter, the amount of leakage of fluid (working oil) to the low-pressure side from between the load transmission pistons 142*a* and the associated balls 142*b* can be reduced. Thus, compatibility between the reductions can be attained.

Also, in the pump apparatus PM1 of the first embodiment, in each of the load transmission pistons 142*a*, the pressure-receiving area S2 of the ball 42*b* subjected to fluid pressure led through the diametrally small communication bore (orifice) 142*a*1 provided in the load transmission piston 142*a* is set slightly smaller than the pressure-receiving area S1 of a diametrally small portion subjected to fluid pressure led through the passages 134 and 135 provided in the reciprocating piston 130 (S1>S2 and S1−S2≅0). Thus, a contact load between the load transmission pistons 142*a* and the associated balls 142*b* can be reduced (a load for providing a seal between the load transmission pistons 142*a* and the associated balls 142*b* can be made to approach zero). Thus, friction between the load transmission pistons 142*a* and the associated balls 142*b* can be reduced, so that wear resistance can be improved.

Also, in the pump apparatus PM1 of the first embodiment, the cylinder bore of the pump housing 120 is composed of the first cylinder bore 121*a* and the second cylinder bore 122*a* which are coaxially aligned and are a predetermined distance apart from each other along the cylinder axis, and the reciprocating piston 130 is integrally provided with the first piston portion 131 which is fitted into the first cylinder bore 121*a* to thereby define the first pump chamber R1 and with the second piston portion 132 which is fitted into the second cylinder bore 122*a* to thereby define the second pump chamber R2.

Thus, the pump apparatus PM1 can be rendered compact. Also, since the first cylinder bore 121*a* and the second cylinder bore 122*a* are coaxially aligned and are a predetermined distance apart from each other along the cylinder axis, a guide length (support span) for the reciprocating piston 130 can be rendered long. Thus, prying force between the reciprocating piston 130 and the pump housing 120 can be restrained, thereby reducing a mechanical loss which occurs in the pump apparatus PM1 due to the prying force.

Also, in the pump apparatus PM1 of the first embodiment, the housing bore 121*c* having a diameter greater than the outside diameter of the reciprocating piston 130 is formed in the pump housing 120 between the first cylinder bore 121*a* and the second cylinder bore 122*a*; the chamber Ra is formed between the housing bore 121*c* and the reciprocating piston 130; the chamber Ra and the first pump chamber R1 are connected through the first suction passage Pi1; and the chamber Ra and the second pump chamber R2 are connected through the second suction passage Pi2. Thus, the chamber Ra can be used in common in the suction channel of the pump apparatus PM1; therefore, there is no need to prepare separate suction ports for the two pump chambers, respectively. That is, the suction channel of the pump apparatus PM1 can be simply configured by means of establishing communication between the single suction port 121*d* and the chamber Ra.

Also, the pump apparatus PM1 of the first embodiment employs a pair of the cam followers 142, which are disposed in the stepped bore 133 of the reciprocating piston 130 in a coaxially aligned manner and are pressed against the cam member 141. Further, the first check valve 136 and the second check valve 137 for leading the fluid pressure of the first pump chamber R1 or the fluid pressure of the second pump chamber R2, whichever is higher, to the both cam followers 142 are provided in the reciprocating piston 130. This can prevent the fluid pressure of the first pump chamber R1 or the fluid pressure of the second pump chamber R2, whichever is lower, from being led to the both cam followers 142. Thus, the both cam followers 142 become unlikely to be pressed back from the cam member 141 in a radial direction of the reciprocating piston 130, whereby suction efficiency in the pump chambers R1 and R2 can be improved.

Since the first check valve 136 and the second check valve 137 are provided in the reciprocating piston 130 and are disposed in the passages 134 and 135, respectively, communicating with the pump chambers R1 and R2, respectively, a pressure chamber formed between the both cam followers 142 can be of a small size, so that a guide length (a length along which each of the load transmission pistons 142*a* is fitted into the reciprocating piston 130) can be rendered sufficiently long for each of the cam followers 142.

Also, the first check valve 136 and the second check valve 137 are disposed such that, at the end of a discharge stroke in each of the pump chambers R1 and R2, the valve plug (ball) of the check valve 136 or 137 corresponding to the pump chamber R1 or R2 in the discharge stroke is closingly seated by itself by the effect of acceleration of a reciprocating motion of the reciprocating piston 130. Thus, each of the check valves 136 and 137 can be a check valve which is not provided with a spring for urging its valve plug (e.g., a ball) toward its valve seat (a so-called ball-free-type check valve); thus, the present invention can be carried out inexpensively.

Also, at the end of a discharge stroke in each of the pump chambers R1 and R2, the valve plug of the check valve 136 or 137 corresponding to the pump chamber R1 or R2 in the discharge stroke is closingly seated by itself; i.e., before start of a suction stroke in each of the pump chambers R1 and R2, the check valve 136 or 137 corresponding to the pump chamber R1 or R2 which is to start the suction stroke is closed. Therefore, when a suction stroke starts in each of the pump chambers R1 and R2, fluid does not flow into the pump chamber R1 or R2 which starts the suction stroke, through the check valve 136 or 137 corresponding to the pump chamber in the suction stroke, whereby suction efficiency in the pump chambers R1 and R2 can be improved.

Figure 3:
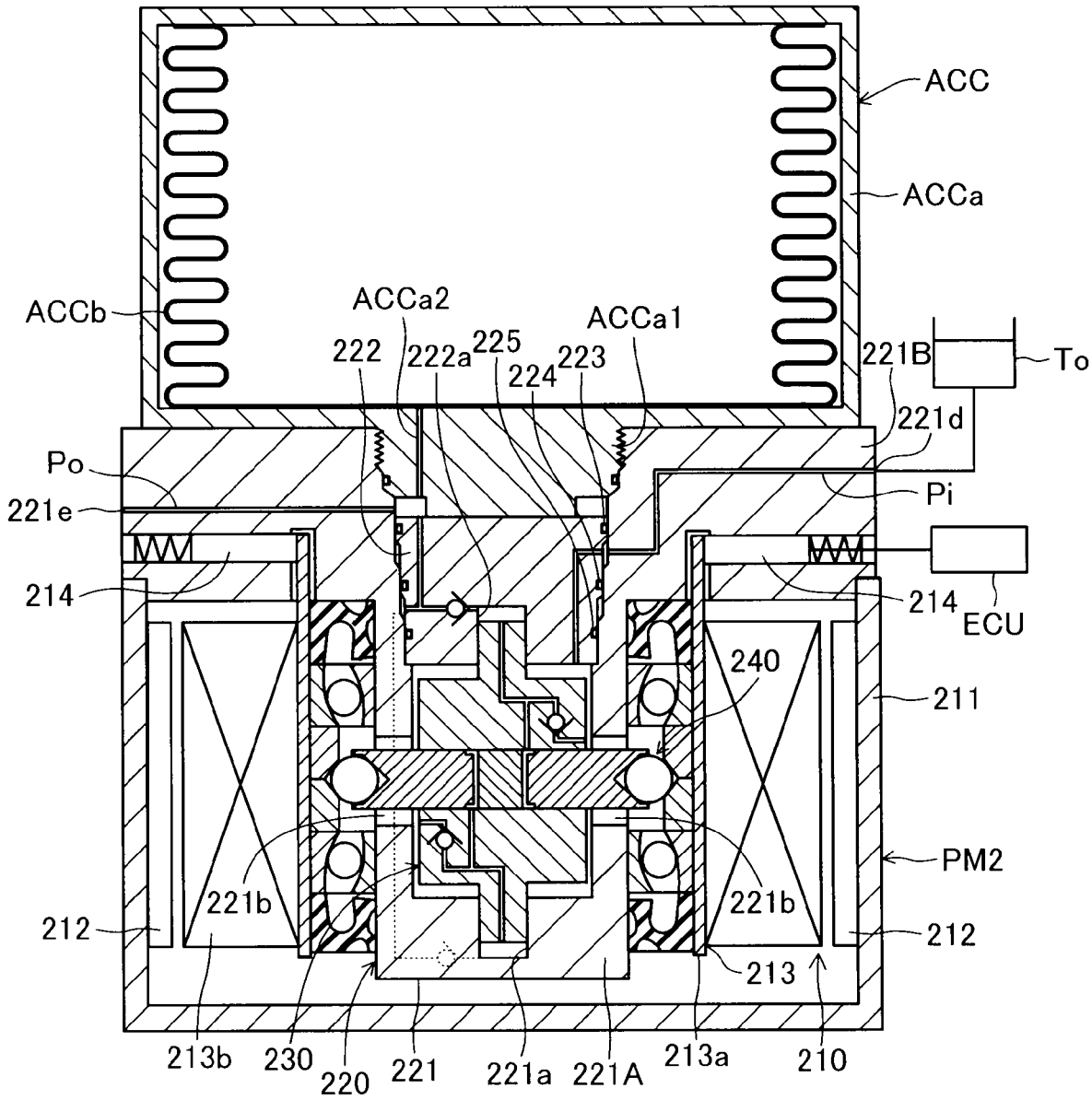
FIG. 3 is an overall, configurational view schematically showing a second embodiment of a motor-driven thrust piston pump apparatus according to the present invention.
Figure 4:
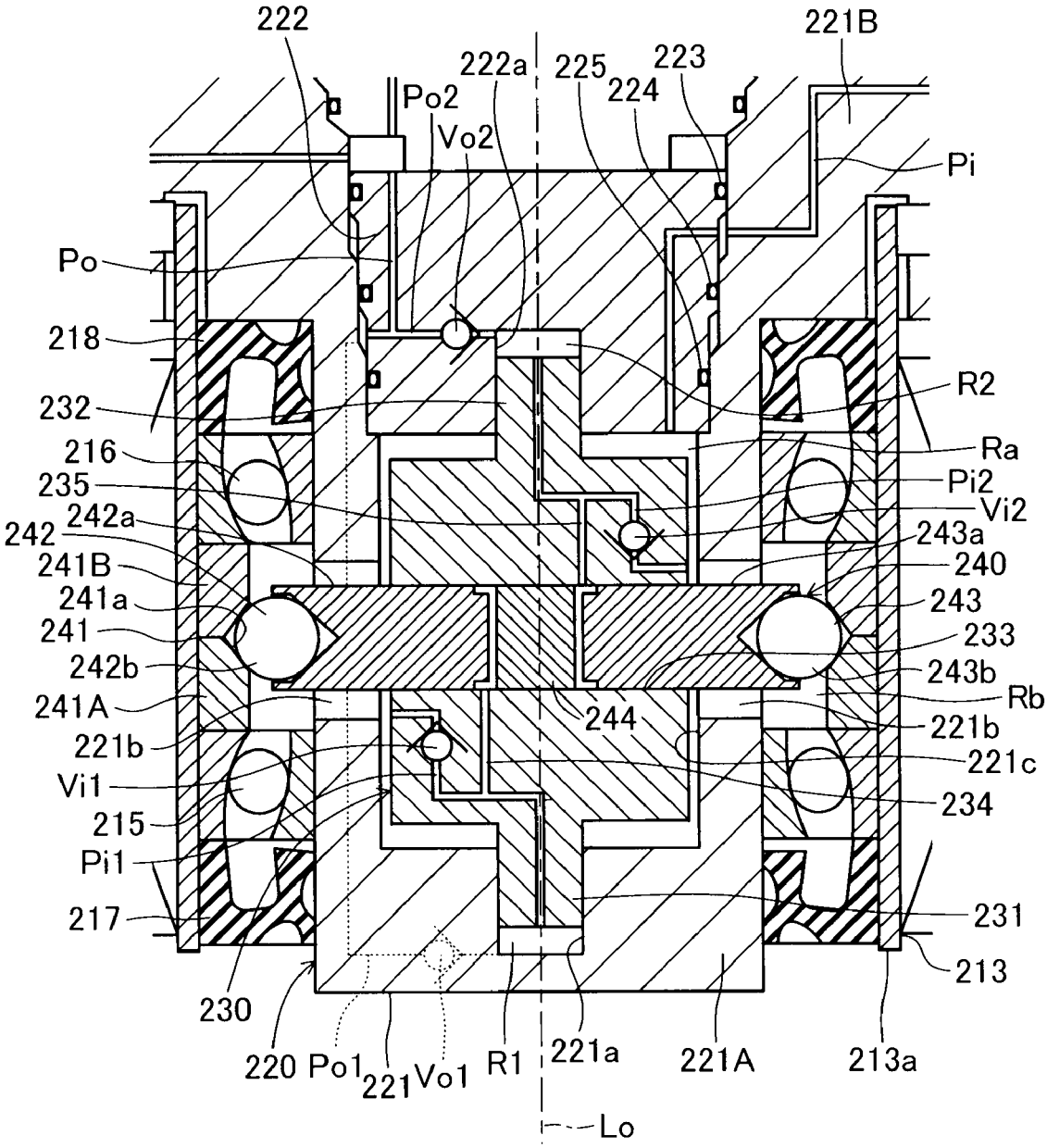
FIG. 4 is an enlarged view of essential portions of the thrust piston pump apparatus shown in FIG. 3.

FIGS. 3 and 4 show a second embodiment of a motor-driven thrust piston pump apparatus according to the present invention. A pump apparatus PM2 of the second embodiment can be driven by an electric motor 210. The accumulator ACC is unitarily attached to the pump apparatus PM2 of the second embodiment, whereby a pressure fluid (pressure oil) discharged from the pump apparatus PM2 can be accumulated in the accumulator ACC. Since the configuration of the accumulator ACC is similar to that of the accumulator ACC employed in the first embodiment described above, like components are denoted by like reference numerals, and repeated description of accumulator configuration is omitted. Also, since the configuration of the electric motor 210 is similar to that of the electric motor 110 employed in the first embodiment described above, like components are denoted by like reference numerals that differ only in the digit denoting hundreds, and repeated description of motor configuration is omitted.

The pump apparatus PM2 is provided with a pump housing 220, a reciprocating piston 230 assembled into the pump housing 220, and a motion conversion mechanism 240 composed of a cam member 241, a first cam follower 242, and a second cam follower 243 and adapted to convert a rotary motion of a rotor 213 of the electric motor 210 in relation to the pump housing 220 and the reciprocating piston 230 to a reciprocating motion of the reciprocating piston 230. Also, the pump apparatus PM2 is provided with the suction passage Pi and the discharge passage Po.

The pump housing 220 is composed of a housing body 221 having a closed-bottomed cylinder portion 221A and an annular flange portion 221B, and a plug 222 attached to the interior of the cylinder portion 221A of the housing body 221. The housing body 221 has a first cylinder bore 221*a* and a pair of axially elongated holes 221*b* formed in its cylinder portion 221A and is assembled to a motor housing 211 of the electric motor 210. The paired axially elongated holes 221*b* collectively serve as guide means for guiding the reciprocating piston 230 and the cam followers 242 and 243 in such a manner that the reciprocating piston 230 and the cam followers 242 and 243 can reciprocate along the cylinder axis. The paired axially elongated holes 221*b* are formed 180 degrees apart from each other in the circumferential direction of the pump housing 220.

A housing bore 221*c* having a diameter greater than the outside diameter of the reciprocating piston 230 is formed in the cylinder portion 221A of the housing body 221. The housing body 221 has a single suction port 221*d* and a single discharge port 221*e* formed in its annular flange portion 221B. The reservoir To is connected to the suction port 221*d*, and hydraulically actuated equipment (not shown) is connected to the discharge port 221*e*.

The plug 222 has a second cylinder bore 222*a*, which is coaxially aligned with and a predetermined distance apart from the above-mentioned first cylinder bore 221*a* along the cylinder axis. The plug 222 is fluid-tightly and coaxially fitted into a stepped bore of the cylinder portion 221A of the housing body 221 via three seal rings; namely, a large seal ring 223, a medium seal ring 224, and a small seal ring 225. Detachment of the plug 222 is prevented by means of the plug portion ACCa1 of the casing ACCa of the accumulator ACC. The second cylinder bore 222*a* of the plug 222 has the same diameter as that of the first cylinder bore 221*a* of the housing body 221.

The reciprocating piston 230 has a diametrally small first piston portion 231, which is fitted into the first cylinder bore 221*a* in such a manner as to be slidable along the cylinder axis and defines the first pump chamber R1, and a diametrally small second piston portion 232, which is fitted into the second cylinder bore 222*a* in such a manner as to be slidable along the cylinder axis and defines the second pump chamber R2. The reciprocating piston 230 is disposed coaxially with the cylinder bores 221*a* and 222*a* and is assembled into the cylinder portion 221A of the pump housing 220 in such a manner as to be able to reciprocate along the cylinder axis. The first piston portion 231 and the second piston portion 232 have the same diameter (the same area subjected to the fluid pressure of the pump chambers R1 and R2, respectively).

A mounting bore 233 is formed in a central region of a diametrally large shaft portion of the reciprocating piston 230 in such a manner as to radially extend through the diametrally large shaft portion. A plug 244 and a pair of cam followers 242 and 243 are coaxially assembled into the mounting bore 233, while the plug 244 partitions the mounting bore 233 into two bores liquid-tightly separated from each other. Notably, in place of the above-mentioned mounting bore (through-hole) 233 and the plug 244, a pair of mounting bores can be provided in the central region of the diametrally large shaft portion of the reciprocating piston 230 in such a manner as to be coaxially aligned with each other and such that the cam followers 242 and 243 can be similarly assembled into the respective mounting bores.

A first passage 234 is formed in the reciprocating piston 230 for leading the fluid pressure (oil pressure) of the first pump chamber R1 toward the first cam follower 242 so as to press the first cam follower 242 against the cam member 241. Also, a second passage 235 is formed in the reciprocating piston 230 for leading the fluid pressure (oil pressure) of the second pump chamber R2 toward the second cam follower 243 so as to press the second cam follower 243 against the cam member 241. The first passage 234 communicates, at its one end, with the first pump chamber R1 and, at its other end, with a pressure chamber between the first cam follower 242 and the plug 244. The second passage 235 communicates, at its one end, with the second pump chamber R2 and, at its other end, with a pressure chamber between the second cam follower 243 and the plug 244.

A cylindrical member 213*a* of the rotor 213 is coaxially disposed around the outer circumference of a cylindrical cylinder portion 221A of the pump housing 220 and is assembled to the pump housing 220 via a pair of bearings 215 and 216 and a pair of annular seal members 217 and 218 in a liquid-tight condition and in such a manner as to be rotatable about the axis Lo in relation to the pump housing 220. The paired bearings 215 and 216 are axially disposed a predetermined distance apart from each other; intervene between the pump housing 220 and the cylindrical member 213*a* of the rotor 213 in such a manner as to axially hold the cam member 241 therebetween; and enable the cylindrical member 213*a* to rotate in relation to the pump housing 220.

The paired annular seal members 217 and 218 are axially disposed a predetermined distance apart from each other; intervene between the pump housing 220 and the cylindrical member 213*a* in such a manner as to axially hold the cam member 241 and the bearings 215 and 216 therebetween; and provide a liquid-tight seal between the pump housing 220 and the cylindrical member 213*a*. The outer chamber Rb formed between the pump housing 220 and the cylindrical member 213*a* and accommodating the bearings 215 and 216, the cam member 241, etc. communicates with the inner chamber Ra formed between the pump housing 220 and the reciprocating piston 230, through a pair of axially elongated holes 221*b* provided in the pump housing 220. The chambers Ra and Rb are filled with fluid (working oil).

The cam member 241 is composed of a pair of cam sleeves 241A and 241B provided in contact with each other along the cylinder axis; is provided in such a manner as to be unitary with the rotor 213 of the electric motor 210 (in such a manner as to be axially immovable and to be rotatable with the rotor 213); and is disposed coaxially with the rotor 213. The cam member 241 has an annular cam portion 241*a* whose axial position circumferentially varies; the cam portion 241*a* is a cam groove; and balls 242*b* and 243*b* of the cam followers 242 and 243 are engaged with the cam groove.

The cam groove 241*a* has cam faces (bevel-faced cams inclined by a predetermined amount with respect to the cylinder axis) which receive an axial load (a load along the vertical direction in the drawings) and a radial load (a load along the horizontal direction in the drawings) from the balls 242*b* and 243*b* of the cam followers 242 and 243. The cam faces form a V-shaped cross section and have an even number of geometric cycles (e.g., two geometric cycles) along the circumferential direction of the rotor 213. Accordingly, when the rotor 213 makes one revolution in relation to the pump housing 220 and the reciprocating piston 230, the cam member 241 can cause the reciprocating piston 230 to reciprocate an even number of times.

The cam followers 242 and 243 are provided with respective load transmission pistons 242*a* and 243*a* assembled to the reciprocating piston 230, and the respective balls (rolling elements) 242*b* and 243*b* rollably assembled to distal end portions of the respective load transmission pistons 242*a* and 243*a* and rollably engaged with the cam portion 241*a* of the cam member 241. The cam followers 242 and 243 are engaged with the cam portion (cam groove) 241*a* of the cam member 241 at their end portions extending in a radial direction perpendicular to the axis Lo; i.e., at the balls 242*b* and 243*b*, and rotate in relation to the cam member 241 to thereby move along the cylinder axis (vertically in the drawings). The load transmission pistons 242*a* and 243*a* have the same diameter (the same area subjected to fluid pressure); are fitted into the mounting bore 233 of the reciprocating piston 230 in such a manner as to be slidable in a radial direction of the reciprocating piston 230; and have taper faces (ball support portions) at their distal end portions for rollably supporting the balls 242*b* and 243*b*, respectively.

The suction passage Pi includes a main suction passage (formed in the pump housing 220) connecting the reservoir To and the inner chamber Ra; a branch suction passage (formed in the reciprocating piston 230) connecting the inner chamber Ra and the first pump chamber R1; namely, the first suction passage Pi1; and a branch suction passage (formed in the reciprocating piston 230) connecting the inner chamber Ra and the second pump chamber R2; namely, the second suction passage Pi2. The first suction check valve V11 is disposed in the first suction passage Pi1. Fluid (working oil) can be sucked into the first pump chamber R1 through the first suction check valve V11. The second suction check valve Vi2 is disposed in the second suction passage Pi2. Fluid (working oil) can be sucked into the second pump chamber R2 through the second suction check valve Vi2.

The discharge passage Po includes a main discharge passage to be connected to hydraulically actuated equipment (not shown); a branch discharge passage connecting the main discharge passage and the first pump chamber R1; namely, the first discharge passage Po1; and a branch discharge passage connecting the main discharge passage and the second pump chamber R2; namely, the second discharge passage Po2. The first discharge check valve Vo1 is disposed in the first discharge passage Po1. A pressure fluid (pressure oil) can be discharged to the main discharge passage from the first pump chamber R1 through the first discharge check valve Vo1. The second discharge check valve Vo2 is disposed in the second discharge passage Po2. A pressure fluid (pressure oil) can be discharged to the main discharge passage from the second pump chamber R2 through the second discharge check valve Vo2. As shown in FIG. 3, the pressure fluid (pressure oil) discharged to the main discharge passage can be accumulated in the accumulator ACC through the communication bore ACCa2 provided in the plug portion ACCa1 of the accumulator ACC and can be supplied toward the hydraulically actuated equipment (not shown) as well. The pressure fluid (pressure oil) supplied to the hydraulically actuated equipment (not shown) returns to the reservoir.

In the thus-configured pump apparatus PM2 of the second embodiment, when the rotor 213 is rotatably driven by the electric motor 210, the motion conversion mechanism 240 converts a rotary motion of the rotor 213 in relation to the pump housing 220 and the reciprocating piston 230 to a reciprocating motion of the reciprocating piston 230, whereby the reciprocating piston 230 performs reciprocation (pumping operation) along the cylinder axis. Accordingly, the pump chambers R1 and R2 alternately increase and decrease in volume, whereby fluid (working oil) which is sucked into the pump chamber R1 or R2 through the suction passage Pi is discharged from the pump chamber R1 or R2 toward the hydraulically actuated equipment (not shown) through the discharge passage Po and is accumulated in the accumulation chamber of the accumulator ACC as well.

Meanwhile, in the pump apparatus PM2 of the second embodiment, since the fluid pressure (oil pressure) of the first pump chamber R1 is led toward the first cam follower 242 through the first passage 234 provided in the reciprocating piston 230, the fluid pressure (oil pressure) of the first pump chamber R1 can press the first cam follower 242 against the cam member 241. Also, since the fluid pressure (oil pressure) of the second pump chamber R2 is led toward the second cam follower 243 through the second passage 235 provided in the reciprocating piston 230, the fluid pressure (oil pressure) of the second pump chamber R2 can press the second cam follower 243 against the cam member 241. Thus, in the pump apparatus PM2, the first and second cam followers 242 and 243 can be optimally pressed against the cam member 241, whereby friction loss and wear, which are useless, can be reduced.

Also, in the pump apparatus PM2 of the second embodiment, during reciprocation of the reciprocating piston 230 along the cylinder axis, even when the cam followers 242 and 243 are pressed back from the cam member 241 in a radial direction of the reciprocating piston 230, the cam followers 242 and 243 exhibit a pumping function in the radial direction of the reciprocating piston 230 (the cam followers 242 and 243 press back the fluid, which is led from the pump chambers R1 and R2 toward the cam followers 242 and 243 through the passages 234 and 235, toward the pump chambers R1 and R2), thereby restraining drop in pump efficiency.

Also, in the pump apparatus PM2 of the second embodiment, the cylinder bore of the pump housing 220 is composed of the first cylinder bore 221*a* and the second cylinder bore 222*a* which are coaxially aligned and are a predetermined distance apart from each other along the cylinder axis, and the reciprocating piston 230 is integrally provided with the first piston portion 231 which is fitted into the first cylinder bore 221*a* to thereby define the first pump chamber R1 and with the second piston portion 232 which is fitted into the second cylinder bore 222*a* to thereby define the second pump chamber R2.

Thus, the pump apparatus PM2 can be rendered compact. Also, since the first cylinder bore 221*a* and the second cylinder bore 222*a* are coaxially aligned and are a predetermined distance apart from each other along the cylinder axis, a guide length (support span) for the reciprocating piston 230 can be rendered long. Thus, prying force between the reciprocating piston 230 and the pump housing 220 can be restrained, thereby reducing a mechanical loss which occurs in the pump apparatus PM2 due to the prying force.

Also, in the pump apparatus PM2 of the second embodiment, the housing bore 221*c* having a diameter greater than the outside diameter of the reciprocating piston 230 is formed in the pump housing 220 between the first cylinder bore 221*a* and the second cylinder bore 222*a*; the chamber Ra is formed between the housing bore 221*c* and the reciprocating piston 230; the chamber Ra and the first pump chamber R1 are connected through the first suction passage Pi1; and the chamber Ra and the second pump chamber R2 are connected through the second suction passage Pi2. Thus, the chamber Ra can be used in common in the suction channel of the pump apparatus PM2; therefore, there is no need to prepare separate suction ports for the two pump chambers, respectively. That is, the suction channel of the pump apparatus PM2 can be simply configured by means of establishing communication between the single suction port 221*d* and the chamber Ra.

Figure 5:
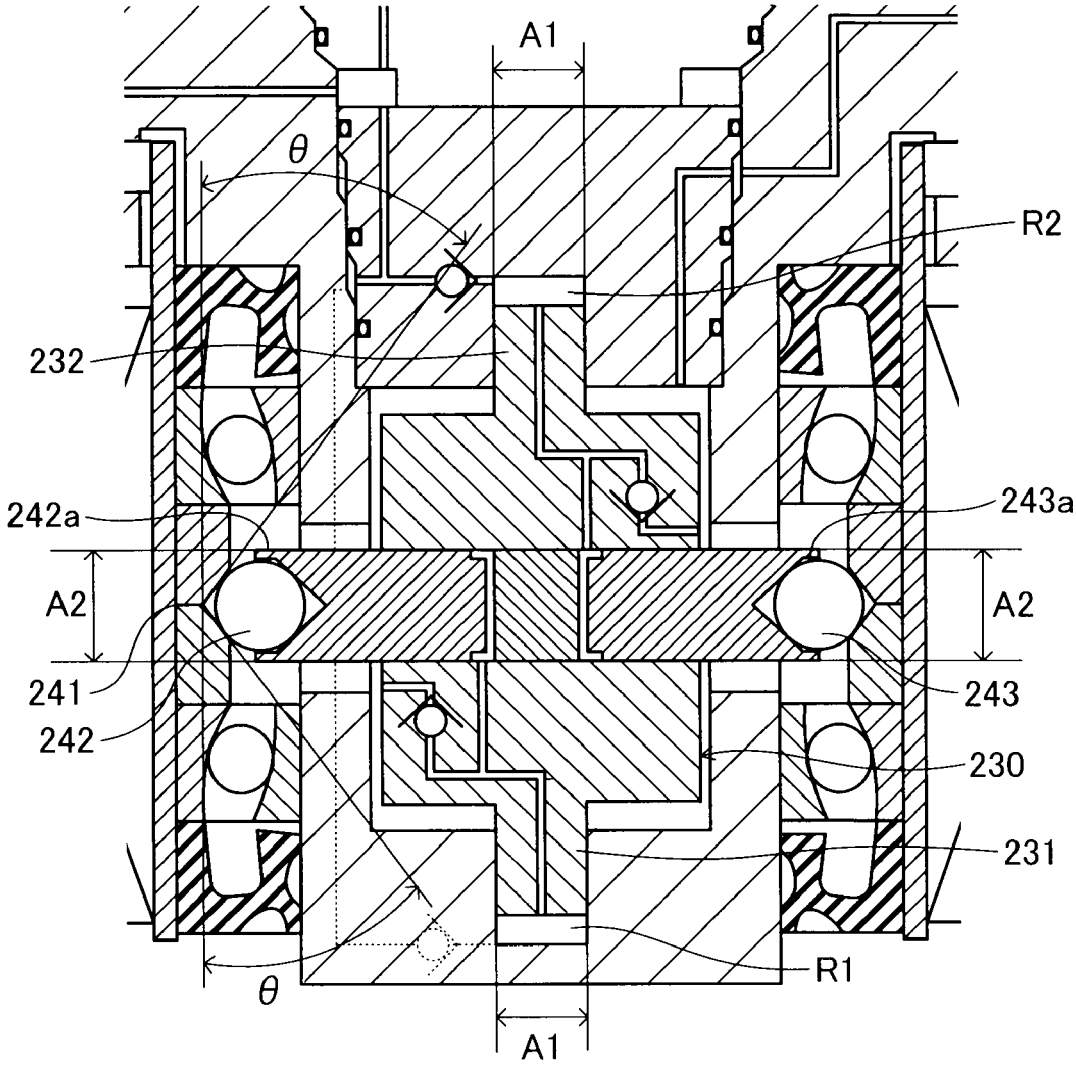
FIG. 5 is an enlarged view of essential portions of the thrust piston pump apparatus shown in FIG. 4, showing a pressure-receiving area A1 of each of a first piston portion and a second piston portion of a reciprocating piston, a pressure-receiving area A2 of a load transmission piston of each cam follower, and an inclination angle θ of each cam.

According to the above-described second embodiment, the motion conversion mechanism 240 is configured such that, during reciprocation of the reciprocating piston 230 along the cylinder axis, the cam followers 242 and 243 can be pressed back from the cam member 241 in a radial direction of the reciprocating piston 230. Specifically, as shown in FIG. 5, A1 is the pressure-receiving area of each of the first piston portion 231 and the second piston portion 232 of the reciprocating piston 230; A2 is the pressure-receiving area of each of the load transmission pistons 242*a* and 243*a* of the cam followers 242 and 243; P is the fluid pressure of each of the pump chambers R1 and R2; and θ is the inclination angle of each cam face of the cam member 241. The pressure-receiving areas A1 and A2 and the inclination angle θ are set such that a working force along the cylinder axis (A2×P×tan θ) which is induced by a radial load exerted on each of the cam followers 242 and 243 by the fluid pressure P of each pump chamber is smaller than a load along the cylinder axis (A1×P) which is exerted on the reciprocating piston 230 by the fluid pressure P of each pump chamber (A1×P>A2×P×tan θ).

However, the second embodiment can also be as follows: the pressure-receiving areas A1 and A2 and the inclination angle θ of each cam face of the cam member 241 are set such that a working force along the cylinder axis (A2×P×tan θ) which is induced by a radial load exerted on each of the cam followers 242 and 243 by the fluid pressure P of each pump chamber is equal to or greater than a load along the cylinder axis (A1×P) which is exerted on the reciprocating piston 230 by the fluid pressure P of each pump chamber (A1×P≦A2×P×tan θ).

In this case (A1×P≦A2×P×tan θ), at any fluid pressure P of each pump chamber, the cam followers 242 and 243 can be appropriately pressed against each cam face of the cam member 241, so that any possible play between the cam member 241 and the cam followers 242 and 243 can be appropriately reduced. As compared with the case where a radial load (A2×P) exerted on the cam followers 242 and 243 is proportional to the fluid pressure P of each pump chamber, and the cam followers are pressed against the cam by means of a spring (in this case, in order to appropriately press the cam followers against the cam at any fluid pressure of the pump chamber, the spring force of the spring must be set large; thus, friction loss between the cam and the cam followers is high at all times), friction loss between the cam member 241 and the cam followers 242 and 243 can be lowered, thereby restraining drop in pump efficiency, which could otherwise result from the friction loss.

Figure 6:
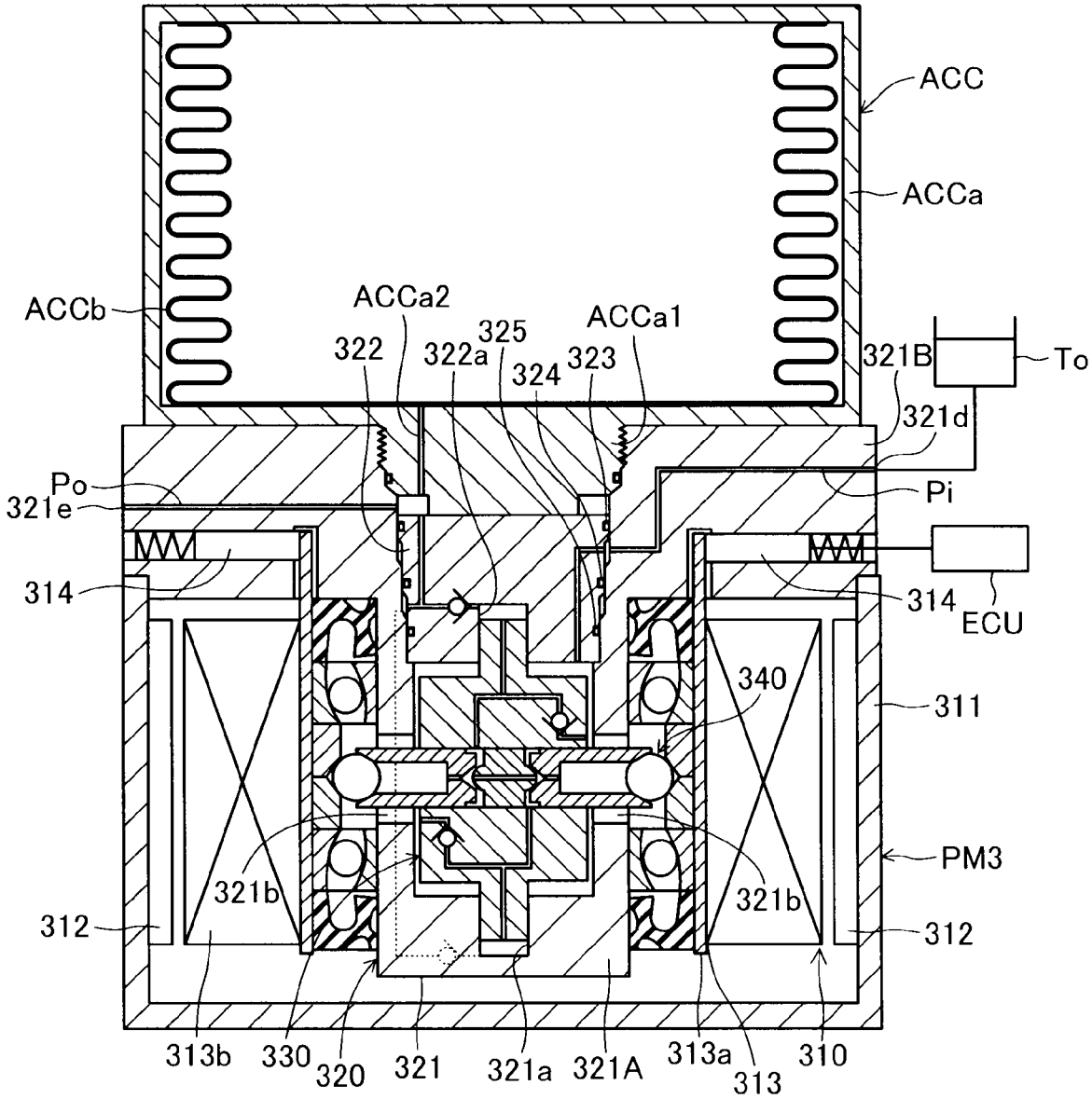
FIG. 6 is an overall, configurational view schematically showing a third embodiment of a motor-driven thrust piston pump apparatus according to the present invention.
Figure 7:
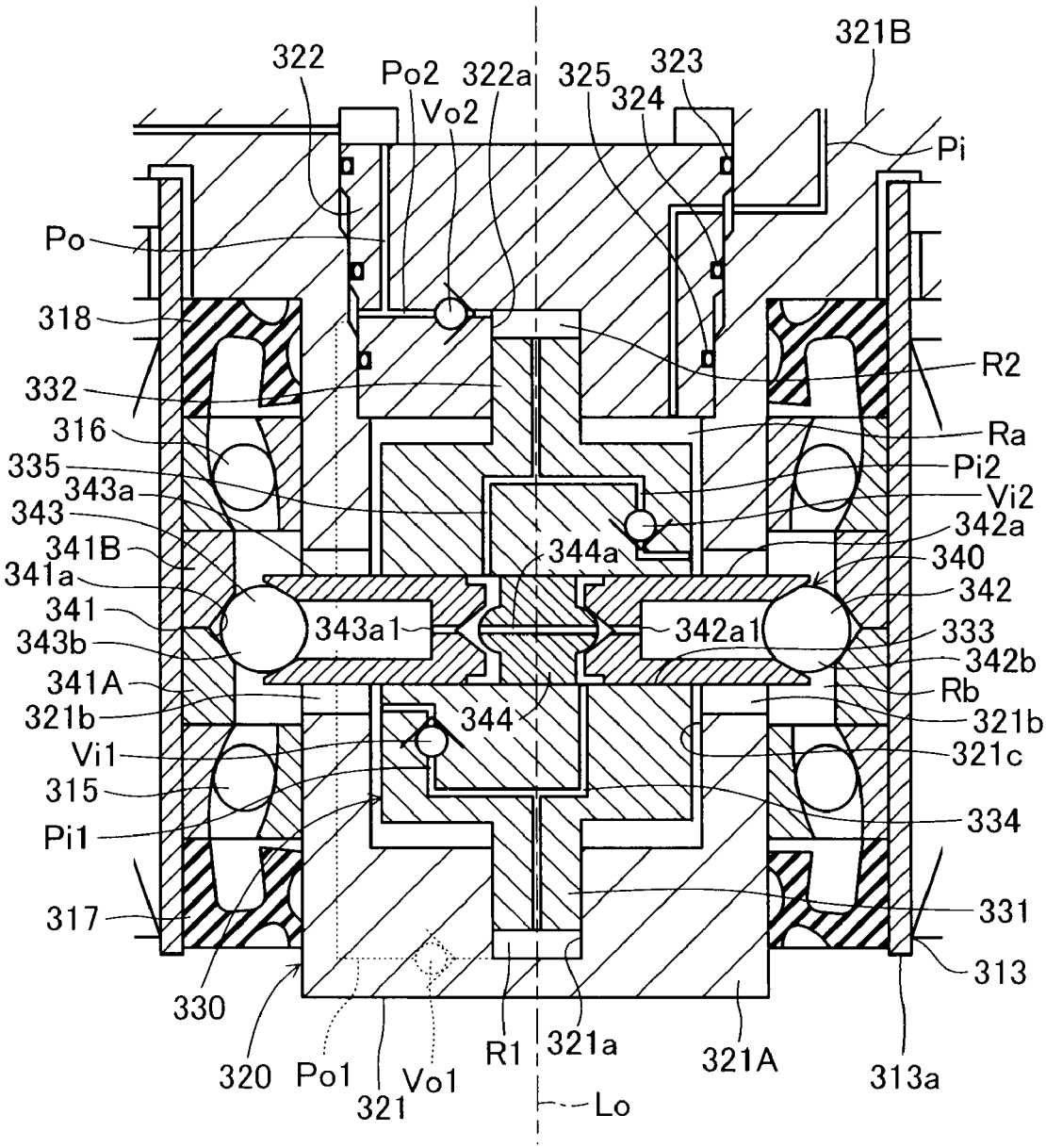
FIG. 7 is an enlarged view of essential portions of the thrust piston pump apparatus shown in FIG. 6.

FIGS. 6 and 7 show a third embodiment of a motor-driven thrust piston pump apparatus according to the present invention. A pump apparatus PM3 of the third embodiment can be driven by an electric motor 310. The accumulator ACC is unitarily attached to the pump apparatus PM3 of the third embodiment, whereby a pressure fluid (pressure oil) discharged from the pump apparatus PM3 can be accumulated in the accumulator ACC. Since the configuration of the accumulator ACC is similar to that of the accumulator ACC employed in the first embodiment described above, like components are denoted by like reference numerals, and repeated description of accumulator configuration is omitted. Also, since the configuration of the electric motor 310 is similar to that of the electric motor 110 employed in the first embodiment described above, like components are denoted by like reference numerals that differ only in the digit denoting hundreds, and repeated description of motor configuration is omitted.

The pump apparatus PM3 is provided with a pump housing 320, a reciprocating piston 330 assembled into the pump housing 320, and a motion conversion mechanism 340 composed of a cam member 341, a first cam follower 342, and a second cam follower 343 and adapted to convert a rotary motion of a rotor 313 of the electric motor 310 in relation to the pump housing 320 and the reciprocating piston 330 to a reciprocating motion of the reciprocating piston 330. Also, the pump apparatus PM3 is provided with the suction passage Pi and the discharge passage Po.

The pump housing 320 is composed of a housing body 321 having a closed-bottomed cylinder portion 321A and an annular flange portion 321B, and a plug 322 attached to the interior of the cylinder portion 321A of the housing body 321. The housing body 321 has a first cylinder bore 321*a* and a pair of axially elongated holes 321*b* formed in its cylinder portion 321A and is assembled to a motor housing 311 of the electric motor 310. The paired axially elongated holes 321*b* collectively serve as guide means for guiding the reciprocating piston 330 and the cam followers 342 and 343 in such a manner that the reciprocating piston 330 and the cam followers 342 and 343 can reciprocate along the cylinder axis. The paired axially elongated holes 321*b* are formed 180 degrees apart from each other in the circumferential direction of the pump housing 320.

A housing bore 321*c* having a diameter greater than the outside diameter of the reciprocating piston 330 is formed in the cylinder portion 321A of the housing body 321. The housing body 321 has a single suction port 321*d* and a single discharge port 321*e* formed in its annular flange portion 321B. The reservoir To is connected to the suction port 321*d*, and hydraulically actuated equipment (not shown) is connected to the discharge port 321*e*.

The plug 322 has a second cylinder bore 322*a*, which is coaxially aligned with and a predetermined distance apart from the above-mentioned first cylinder bore 321*a* along the cylinder axis. The plug 322 is fluid-tightly and coaxially fitted into a stepped bore of the cylinder portion 321A of the housing body 321 via three seal rings; namely, a large seal ring 323, a medium seal ring 324, and a small seal ring 325. Detachment of the plug 322 is prevented by means of the plug portion ACCa1 of the casing ACCa of the accumulator ACC. The second cylinder bore 322*a* of the plug 322 has the same diameter as that of the first cylinder bore 321*a* of the housing body 321.

The reciprocating piston 330 has a diametrally small first piston portion 331, which is fitted into the first cylinder bore 321*a* in such a manner as to be slidable along the cylinder axis and defines the first pump chamber R1, and a diametrally small second piston portion 332, which is fitted into the second cylinder bore 322*a* in such a manner as to be slidable along the cylinder axis and defines the second pump chamber R2. The reciprocating piston 330 is disposed coaxially with the cylinder bores 321*a* and 322*a* and is assembled into the pump housing 320 in such a manner as to be able to reciprocate along the cylinder axis. The first piston portion 331 and the second piston portion 332 have the same diameter (the same area subjected to fluid pressure). A mounting bore 333 is formed in a central region of a diametrally large shaft portion of the reciprocating piston 330 in such a manner as to radially extend through the diametrally large shaft portion. A valve plunger 344, a first cam follower 342, and a second cam follower 343 are coaxially assembled into the mounting bore 333, while the valve plunger 344 partitions the mounting bore 333 into two bores.

A first passage 334 is formed in the reciprocating piston 330 for leading the fluid pressure (oil pressure) of the first pump chamber R1 toward the cam followers 342 and 343 so as to press the cam followers 342 and 343 against the cam member 341. Also, a second passage 335 is formed in the reciprocating piston 330 for leading the fluid pressure (oil pressure) of the second pump chamber R2 toward the cam followers 342 and 343 so as to press the cam followers 342 and 343 against the cam member 341. The first passage 334 communicates, at its one end, with the first pump chamber R1 and, at its other end, with a pressure chamber between the first cam follower 342 and the valve plunger 344. The second passage 335 communicates, at its one end, with the second pump chamber R2 and, at its other end, with a pressure chamber between the second cam follower 343 and the valve plunger 344.

A cylindrical member 313*a* of the rotor 313 is coaxially disposed around the outer circumference of a cylindrical cylinder portion 321A of the pump housing 320 and is assembled to the pump housing 320 via a pair of bearings 315 and 316 and a pair of annular seal members 317 and 318 in a liquid-tight condition and in such a manner as to be rotatable about the axis Lo in relation to the pump housing 320. The paired bearings 315 and 316 are axially disposed a predetermined distance apart from each other; intervene between the pump housing 320 and the cylindrical member 313*a* of the rotor 313 in such a manner as to axially hold the cam member 341 therebetween; and enable the cylindrical member 313*a* to rotate in relation to the pump housing 320.

The paired annular seal members 317 and 318 are axially disposed a predetermined distance apart from each other; intervene between the pump housing 320 and the cylindrical member 313*a* in such a manner as to axially hold the cam member 341 and the bearings 315 and 316 therebetween; and provide a liquid-tight seal between the pump housing 320 and the cylindrical member 313*a*. The outer chamber Rb formed between the pump housing 320 and the cylindrical member 313*a* and accommodating the bearings 315 and 316, the cam member 341, etc. communicates with the inner chamber Ra formed between the pump housing 320 and the reciprocating piston 330, through a pair of axially elongated holes 321*b* provided in the pump housing 320. The chambers Ra and Rb are filled with fluid (working oil).

The cam member 341 is composed of a pair of cam sleeves 341A and 341B provided in contact with each other along the cylinder axis; is provided in such a manner as to be unitary with the rotor 313 (in such a manner as to be axially immovable and to be rotatable with the rotor 313); and is disposed coaxially with the rotor 313. The cam member 341 has an annular cam portion 341*a* whose axial position circumferentially varies; the cam portion 341*a* is a cam groove; and balls 342*b* and 343*b* of the cam followers 342 and 343 are engaged with the cam groove. The cam groove 341*a* has cam faces (bevel-faced cams inclined by a predetermined amount with respect to the cylinder axis) which receive an axial load (a load along the vertical direction in the drawings) and a radial load (a load along the horizontal direction in the drawings) from the balls 342*b* and 343*b* of the cam followers 342 and 343. The cam faces form a V-shaped cross section and have an even number of geometric cycles (e.g., two geometric cycles) along the circumferential direction of the rotor 313. Accordingly, when the rotor 313 makes one revolution in relation to the pump housing 320 and the reciprocating piston 330, the cam member 341 can cause the reciprocating piston 330 to reciprocate an even number of times.

The cam followers 342 and 343 are provided with respective load transmission pistons 342*a* and 343*a* assembled to the reciprocating piston 330, and the respective balls (rolling elements) 342*b* and 343*b* rollably assembled to distal end portions of the respective load transmission pistons 342*a* and 343*a* and rollably engaged with the cam portion 341*a* of the cam member 341. The cam followers 342 and 343 are engaged with the cam portion (cam groove) 341*a* of the cam member 341 at their end portions extending in a radial direction perpendicular to the axis Lo; i.e., at the balls 342*b* and 343*b*, and rotate in relation to the cam member 341 to thereby move along the cylinder axis (vertically in the drawings).

The load transmission pistons 342*a* and 343*a* have the same diameter (the same area subjected to fluid pressure); are fitted into the mounting bore 333 of the reciprocating piston 330 in such a manner as to be slidable in a radial direction of the reciprocating piston 330; and have taper faces (ball support portions) at their distal end portions for rollably supporting the balls 342*b* and 343*b*, respectively. Valve seats are formed at inner end portions of the respective load transmission pistons 342*a* and 343*a* such that respective spherical valve plugs of the valve plunger 344 can be seated thereon and depart therefrom. Also, diametrally small communication bores (orifices) 342*a*1 and 342*a*2 are provided in axially core portions of the respective load transmission pistons 342*a* and 343*a* and are adapted to lead the fluid pressure of each of the pump chambers R1 and R2 toward the ball support portions.

The valve plunger 344 and the cam followers 342 and 343 collectively serve as a changeover valve for leading the fluid pressure of the first pump chamber R1 or the fluid pressure of the second pump chamber R2, whichever is higher, to the first cam follower 342 and to the second cam follower 343. The valve plunger 344 is a valve plug coaxially aligned with and intervening between the valve seat formed at the inner end of the first cam follower 342 and the valve seat formed at the inner end of the second cam follower 343; is fitted into the mounting bore 333 in an axially slidable condition; and axially slides in the mounting bore 333 according to a difference between fluid pressures exerted on its opposite end portions, thereby being seated on either one of the valve seats. A diametrally small bore (orifice) 344*a* axially extends through the axial core of the valve plunger 344.

The suction passage Pi includes a main suction passage connecting the reservoir To and the inner chamber Ra; a branch suction passage connecting the inner chamber Ra and the first pump chamber R1; namely, the first suction passage Pi1; and a branch suction passage connecting the inner chamber Ra and the second pump chamber R2; namely, the second suction passage Pi2. The first suction check valve V11 is disposed in the first suction passage Pi1. Fluid (working oil) can be sucked into the first pump chamber R1 through the first suction check valve V11. The second suction check valve Vi2 is disposed in the second suction passage Pi2. Fluid (working oil) can be sucked into the second pump chamber R2 through the second suction check valve Vi2.

The discharge passage Po includes a main discharge passage to be connected to hydraulically actuated equipment (not shown); a branch discharge passage connecting the main discharge passage and the first pump chamber R1; namely, the first discharge passage Po1; and a branch discharge passage connecting the main discharge passage and the second pump chamber R2; namely, the second discharge passage Po2. The first discharge check valve Vo1 is disposed in the first discharge passage Po1. A pressure fluid (pressure oil) can be discharged to the main discharge passage from the first pump chamber R1 through the first discharge check valve Vo1. The second discharge check valve Vo2 is disposed in the second discharge passage Po2. A pressure fluid (pressure oil) can be discharged to the main discharge passage from the second pump chamber R2 through the second discharge check valve Vo2. The pressure fluid (pressure oil) discharged to the main discharge passage can be accumulated in the accumulator ACC through the communication bore ACCa2 provided in the plug portion ACCa1 of the accumulator ACC and can be supplied toward the hydraulically actuated equipment (not shown) as well. The pressure fluid (pressure oil) supplied to the hydraulically actuated equipment (not shown) returns to the reservoir.

In the thus-configured pump apparatus PM3 of the third embodiment, when the rotor 313 is rotatably driven by the electric motor 310, the motion conversion mechanism 340 converts a rotary motion of the rotor 313 in relation to the pump housing 320 and the reciprocating piston 330 to a reciprocating motion of the reciprocating piston 330, whereby the reciprocating piston 330 performs reciprocation (pumping operation) along the cylinder axis. Accordingly, the pump chambers R1 and R2 alternately increase and decrease in volume, whereby fluid (working oil) which is sucked into the pump chamber R1 or R2 through the suction passage Pi is discharged from the pump chamber R1 or R2 toward the hydraulically actuated equipment (not shown) through the discharge passage Po and is accumulated in the accumulation chamber of the accumulator ACC as well.

Meanwhile, in the pump apparatus PM3 of the third embodiment, since the fluid pressure (oil pressure) of the pump chamber R1 and that of the pump chamber R2 are led toward the cam followers 342 and 343 through the passages 334 and 335, respectively, provided in the reciprocating piston 330, the fluid pressure (oil pressure) of the pump chamber R1 and that of the pump chamber R2 can press the cam followers 342 and 343, respectively, against the cam member 341. Thus, irrespective of discharge pressure of the pump apparatus PM3, the cam followers 342 and 343 can be appropriately (under high pressure when the discharge pressure is high, or under low pressure when the discharge pressure is low) pressed against the cam member 341, whereby pump efficiency can be improved. Further, any possible play between the cam member 341 and the cam followers 342 and 343 can be restrained by a simple configuration (by means of the passages 334 and 335 provided in the reciprocating piston 330).

Also, in the pump apparatus PM3 of the third embodiment, the cam followers 342 and 343 are provided with the respective load transmission pistons 342*a* and 343*a* assembled to the reciprocating piston 330, and the respective balls 342*b* and 343*b* rollably assembled to distal end portions of the respective load transmission pistons 342*a* and 343*a* and engaged with the cam member 341. Also, the diametrally small communication bores 342*a*1 and 343*a*1 for leading the fluid pressure (oil pressure) of the pump chamber R1 and that of the pump chamber R2 toward the ball support portions of the load transmission pistons 342*a* and 343*a* are provided in the respective load transmission pistons 342*a* and 343*a*. Thus, the fluid pressure (oil pressure) of the pump chamber R1 and that of the pump chamber R2 are led toward the ball support portions of the load transmission pistons 342*a* and 343*a*. Therefore, a contact load between the load transmission pistons 342*a* and 343*a* and the associated balls 342*b* and 343*b* can be reduced. Thus, sliding resistance and the amount of wear between the load transmission pistons 342*a* and 343*a* and the associated balls 342*b* and 343*b* can be reduced.

Also, in the pump apparatus PM3 of the third embodiment, taper faces for rollably supporting the respective balls 342*b* and 343*b* are formed at the distal end portions of the respective load transmission pistons 342*a* and 343*a*, and the communication bores 342*a*1 and 343*a*1 provided in the respective load transmission pistons 342*a* and 343*a* assume a small diameter (orifice). Thus, by means of imparting a large diameter to the taper faces, a contact load between the load transmission pistons 342*a* and 343*a* and the associated balls 342*b* and 343*b* can be reduced. Also, by means of employing a small orifice diameter, the amount of leakage of fluid to the low-pressure side from between the load transmission pistons 342*a* and 343*a* and the associated balls 342*b* and 343*b* can be reduced. Thus, compatibility between the reductions can be attained.

Also, in the pump apparatus PM3 of the third embodiment, the cylinder bore of the pump housing 320 is composed of the first cylinder bore 321*a* and the second cylinder bore 322*a* which are coaxially aligned and are a predetermined distance apart from each other along the cylinder axis, and the reciprocating piston 330 is integrally provided with the first piston portion 331 which is fitted into the first cylinder bore 321*a* to thereby define the first pump chamber R1 and with the second piston portion 332 which is fitted into the second cylinder bore 322*a* to thereby define the second pump chamber R2.

Thus, the pump apparatus PM3 can be rendered compact. Also, since the first cylinder bore 321*a* and the second cylinder bore 322*a* are coaxially aligned and are a predetermined distance apart from each other along the cylinder axis, a guide length (support span) for the reciprocating piston 330 can be rendered long. Thus, prying force between the reciprocating piston 330 and the pump housing 320 can be restrained, thereby reducing a mechanical loss which occurs in the pump apparatus PM3 due to the prying force.

Also, in the pump apparatus PM3 of the third embodiment, the housing bore 321*c* having a diameter greater than the outside diameter of the reciprocating piston 330 is formed in the pump housing 320 between the first cylinder bore 321*a* and the second cylinder bore 322*a*; the chamber Ra is formed between the housing bore 321*c* and the reciprocating piston 330; the chamber Ra and the first pump chamber R1 are connected through the first suction passage Pi1; and the chamber Ra and the second pump chamber R2 are connected through the second suction passage Pi2. Thus, the chamber Ra can be used in common in the suction channel of the pump apparatus PM3; therefore, there is no need to prepare separate suction ports for the two pump chambers, respectively. That is, the suction channel of the pump apparatus PM3 can be simply configured by means of establishing communication between the single suction port 321*d* and the chamber Ra.

Also, the pump apparatus PM3 of the third embodiment employs the first cam follower 342 and the second cam follower 343, which are disposed in the mounting bore 333 of the reciprocating piston 330 in a coaxially aligned manner and are pressed against the cam member 341; the plunger 344 intervenes between the cam followers 342 and 343; and a changeover valve composed of the cam followers 342 and 343 and the plunger 344 leads the fluid pressure of the first pump chamber R1 or the fluid pressure of the second pump chamber R2, whichever is higher, to the cam followers 342 and 343.

This can prevent the fluid pressure of the first pump chamber R1 or the fluid pressure of the second pump chamber R2, whichever is lower, from being led to the cam followers 342 and 343. Thus, the cam followers 342 and 343 become unlikely to be pressed back from the cam member 341 in a radial direction of the reciprocating piston 330, whereby suction efficiency in the pump chambers R1 and R2 can be improved. Also, the above-mentioned changeover valve is composed of the cam followers 342 and 343 and the valve plunger 344, thereby effectively utilizing the cam followers 324 and 343. Therefore, the changeover valve can be simply configured.

Figure 8:
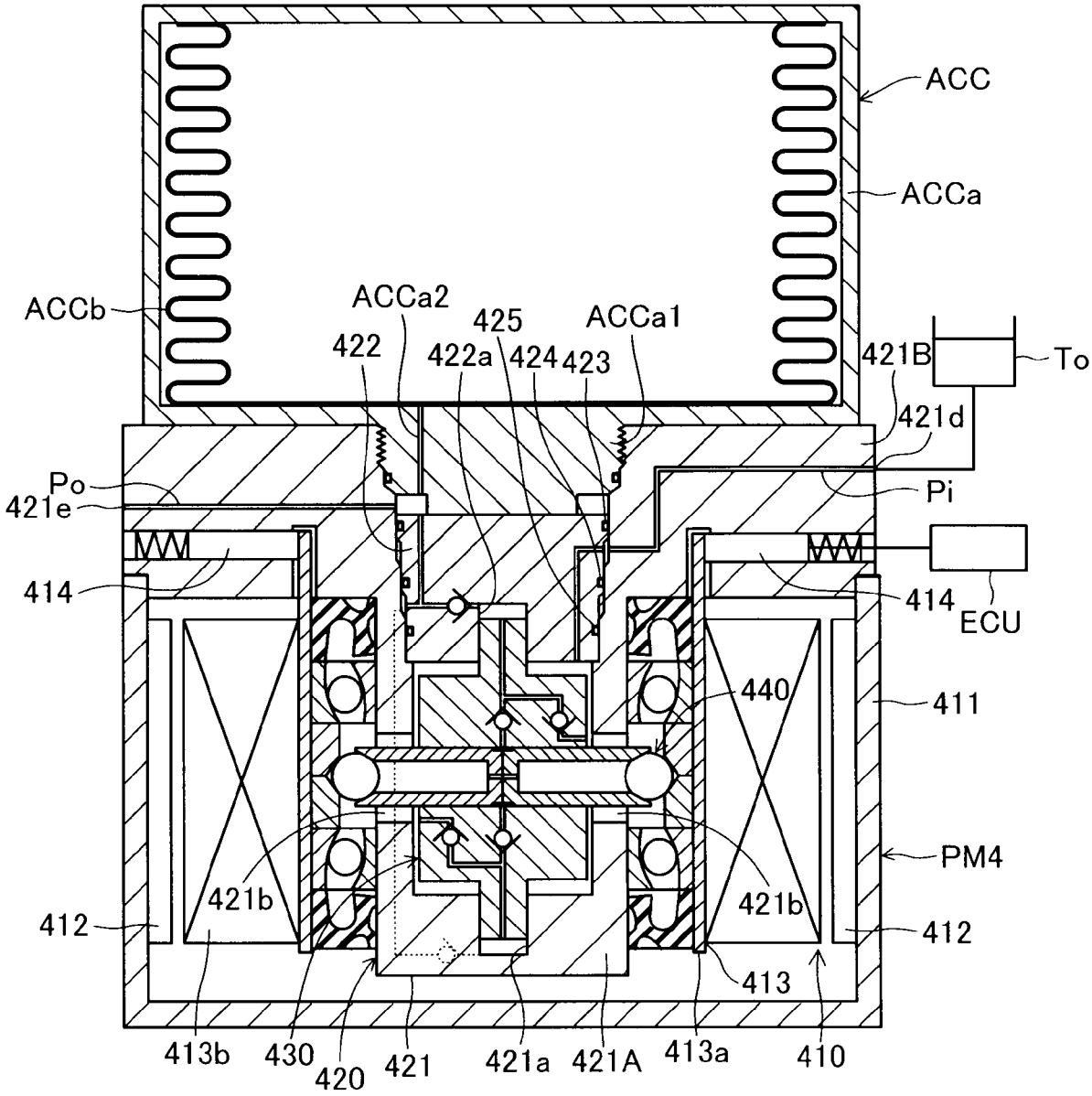
FIG. 8 is an overall, configurational view schematically showing a fourth embodiment of a motor-driven thrust piston pump apparatus according to the present invention.
Figure 9:
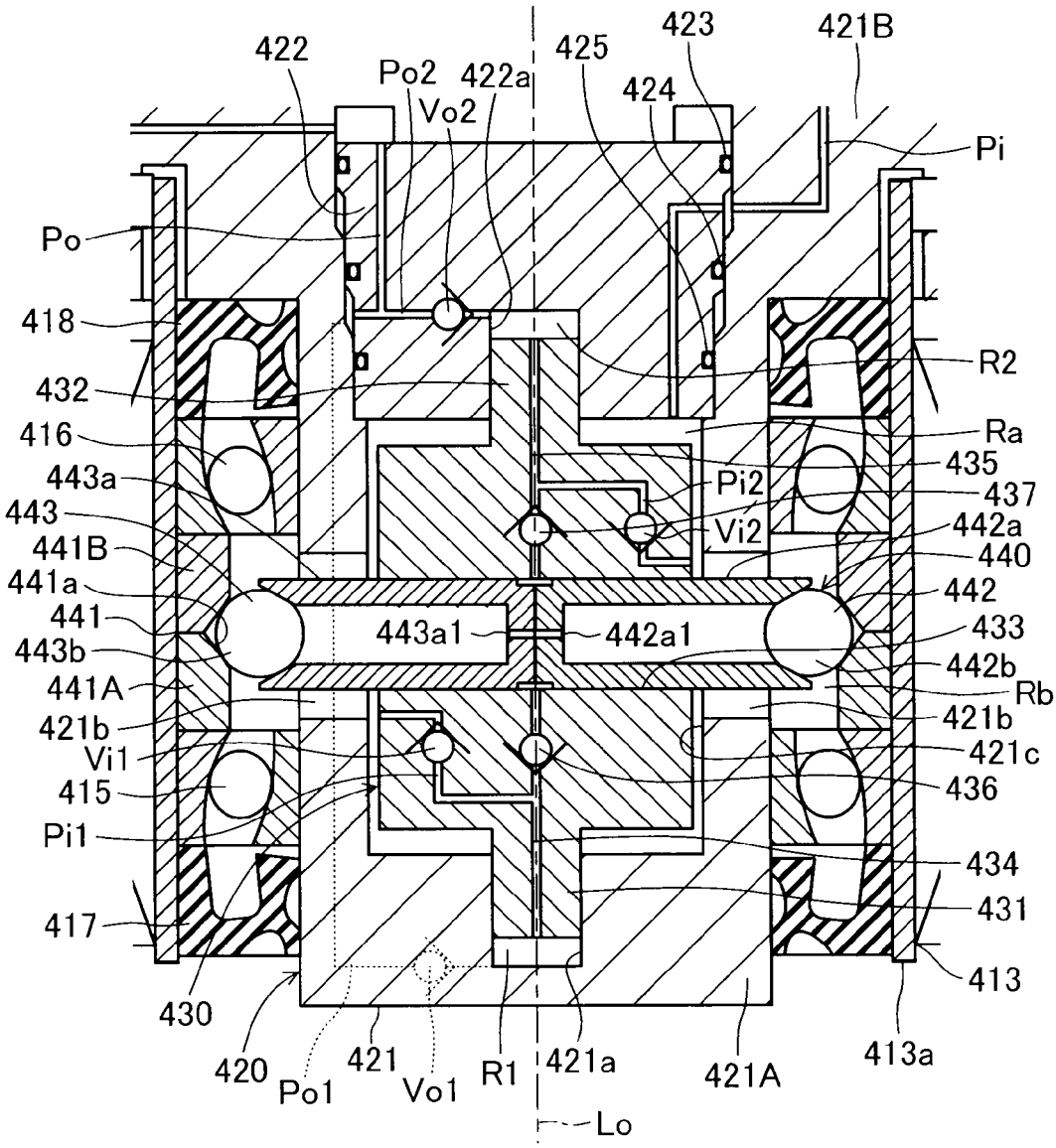
FIG. 9 is an enlarged view of essential portions of the thrust piston pump apparatus shown in FIG. 8.

FIGS. 8 and 9 show a fourth embodiment of a motor-driven thrust piston pump apparatus according to the present invention. A pump apparatus PM4 of the fourth embodiment can be driven by an electric motor 410. The accumulator ACC is unitarily attached to the pump apparatus PM4 of the fourth embodiment, whereby a pressure fluid (pressure oil) discharged from the pump apparatus PM4 can be accumulated in the accumulator ACC. Since the configuration of the accumulator ACC is similar to that of the accumulator ACC employed in the first embodiment described above, like components are denoted by like reference numerals, and repeated description of accumulator configuration is omitted. Also, since the configuration of the electric motor 410 is similar to that of the electric motor 110 employed in the first embodiment described above, like components are denoted by like reference numerals that differ only in the digit denoting hundreds, and repeated description of the motor configuration is omitted.

The pump apparatus PM4 is provided with a pump housing 420, a reciprocating piston 430 assembled into the pump housing 420, and a motion conversion mechanism 440 composed of a cam member 441, a first cam follower 442, and a second cam follower 443 and adapted to convert a rotary motion of a rotor 413 of the electric motor 410 in relation to the pump housing 420 and the reciprocating piston 430 to a reciprocating motion of the reciprocating piston 430. Also, the pump apparatus PM4 is provided with the suction passage Pi and the discharge passage Po.

The pump apparatus PM4 employs a first check valve 436 and a second check valve 437 corresponding to the first check valve 136 and the second check valve 137, respectively, of the first embodiment, in place of the changeover valve of the third embodiment composed of the cam followers 342 and 343 and the valve plunger 344. Since other configurational features are similar to those of the third embodiment described above, the other configurational features are denoted by like reference numerals that differ only in the digit denoting hundreds, and repeated description thereof is omitted.

The thus-configured fourth embodiment yields actions and effects similar to those of the third embodiment except those which the changeover valve composed of the cam followers 342 and 343 and the plunger 344 yields. The fourth embodiment also yields actions and effects similar to those which the first check valve 136 and the second check valve 137 in the first embodiment cooperatively yield. Therefore, repeated description of actions and effects of the fourth embodiment is omitted.

According to the above-described embodiments, the present invention is embodied in the motor-driven thrust piston pump apparatus of a double-acting type (the reciprocating piston provides a pumping operation at its opposite end portions). However, the present invention can also be embodied in a motor-driven thrust piston pump apparatus of a single-acting type (the reciprocating piston provides a pumping operation at either one of its opposite end portions).

According to the above-described embodiments, the present invention is embodied in the thrust piston pump apparatus for hydraulic use in which fluid to be sucked into and discharged from the pump chambers is working oil. However, the present invention can also be embodied, similarly or with appropriate modifications, in a thrust piston pump apparatus for pneumatic use in which fluid to be sucked into and discharged from the pump chambers is air.

The invention claimed is:

1. A motor-driven thrust piston pump apparatus comprising:

a stator of an electric motor;

a tubular rotor disposed in the stator;

a cylinder portion of a pump housing coaxially housed in the rotor; and a reciprocating piston assembled into a cylinder bore of the cylinder portion in such a manner as to be able to reciprocate along a cylinder axis and define a pump chamber in the cylinder bore, wherein the pump housing includes a suction passage for allowing a fluid to be taken therethrough into the pump chamber and a discharge passage for allowing the fluid to be discharged therethrough from the pump chamber, and wherein a motion conversion mechanism is provided between the reciprocating piston and the rotor so as to convert a rotary motion of the rotor to a reciprocating motion of the reciprocating piston.

2. A motor-driven thrust piston pump apparatus according to claim 1, wherein the motion conversion mechanism is a cam mechanism provided with a cam which rotates unitarily with the rotor and which has a cam groove formed along its inner circumference, and a cam follower which is assembled to the reciprocating piston and engaged with the cam groove and which moves unitarily with the reciprocating piston along the cylinder axis.

3. A motor-driven thrust piston pump apparatus according to claim 1, wherein the pump housing has a flange portion whose one side closes a motor housing of the electric motor, and an accumulator for accumulating the fluid discharged through the reciprocating motion of the reciprocating piston is attached to the other side of the flange portion.

4. A motor-driven thrust piston pump apparatus according to claim 2, wherein the pump housing has a flange portion whose one side closes a motor housing of the electric motor, and an accumulator for accumulating the fluid discharged through the reciprocating motion of the reciprocating piston is attached to the other side of the flange portion.

5. A motor-driven thrust piston pump apparatus according to claim 1, wherein the motion conversion mechanism is provided with a cam which is unitarily provided on the rotor, and a cam follower which is assembled to the reciprocating piston in such a manner as to be radially movable in relation to the reciprocating piston and to be movable along the cylinder axis unitarily with the reciprocating piston; which is movable along the cylinder axis and nonrotatable in relation to the cylinder portion; and which is engaged with the cam; and a passage for leading a fluid pressure of the pump chamber toward the cam follower so as to press the cam follower against the cam is provided in the reciprocating piston.

6. A motor-driven thrust piston pump apparatus according to claim 5, wherein the cam is a bevel-faced cam inclined by a predetermined amount with respect to the cylinder axis, and a working force along the cylinder axis which is induced by a radial load exerted on the cam follower by the fluid pressure of the pump chamber is set equal to or greater than a load along the cylinder axis which is exerted on the reciprocating piston by the fluid pressure of the pump chamber.

7. A motor-driven thrust piston pump apparatus according to claim 5, wherein the cam follower includes a load transmission piston assembled to the reciprocating piston, and a rolling element rollably assembled to a distal end portion of the load transmission piston and engaged with the cam, and a communication bore for leading the fluid pressure of the pump chamber toward a rolling-element support portion of the load transmission piston is provided in the load transmission piston.

8. A motor-driven thrust piston pump apparatus according to claim 7, wherein a taper face for rollably supporting the rolling element is formed at the distal end portion of the load transmission piston, and an orifice is provided in the communication bore provided in the load transmission piston.

9. A motor-driven thrust piston pump apparatus according to claim 7, wherein a pressure-receiving area of the rolling element subjected to the fluid pressure led through the communication bore provided in the load transmission piston is set slightly smaller than a pressure-receiving area of the load transmission piston subjected to the fluid pressure led through the passage provided in the reciprocating piston.

10. A motor-driven thrust piston pump apparatus according to claim 5, wherein the cylinder bore of the cylinder portion is composed of a first cylinder bore and a second cylinder bore which are coaxially aligned and are a predetermined distance apart from each other along the cylinder axis, and the reciprocating piston is integrally provided with a first piston portion which is fitted into the first cylinder bore to thereby define a first pump chamber and with a second piston portion which is fitted into the second cylinder bore to thereby define a second pump chamber.

11. A motor-driven thrust piston pump apparatus according to claim 10, wherein a housing bore having a diameter greater than an outside diameter of the reciprocating piston is formed in the cylinder portion between the first cylinder bore and the second cylinder bore; a chamber is formed between the housing bore and the reciprocating piston; the chamber and the first pump chamber are connected through a first suction passage; and the chamber and the second pump chamber are connected through a second suction passage.

12. A motor-driven thrust piston pump apparatus according to claim 10, wherein the cam follower is composed of a first cam follower which is pressed against the cam under the fluid pressure of the first pump chamber, and a second cam follower which is pressed against the cam under the fluid pressure of the second pump chamber.

13. A motor-driven thrust piston pump apparatus according to claim 10, wherein the cam follower is composed of a first cam follower and a second cam follower which are coaxially aligned and are pressed against the cam, and a changeover valve for leading the fluid pressure of the first pump chamber or the fluid pressure of the second pump chamber, whichever is higher, to the first cam follower and to the second cam follower is provided in the reciprocating piston.

14. A motor-driven thrust piston pump apparatus according to claim 13, wherein the changeover valve includes a valve plug which is placed between and coaxially aligned with the first cam follower and the second cam follower in an axially movable manner, and a pair of valve seats being formed on the first cam follower and the second cam follower, respectively, and allowing the valve plug to be seated thereon and to depart therefrom.

15. A motor-driven thrust piston pump apparatus according to claim 13, wherein the changeover valve is composed of a first check valve disposed in a first passage provided in the reciprocating piston and communicating with the first pump chamber, and adapted to prevent flow to the first pump chamber, and a second check valve disposed in a second passage provided in the reciprocating piston and communicating with the second pump chamber, and adapted to prevent flow to the second pump chamber.

16. A motor-driven thrust piston pump apparatus according to claim 15, wherein the check valves are disposed such that, at the end of a discharge stroke in each of the pump chambers, the valve plug of the check valve corresponding to the pump chamber in the discharge stroke is closingly seated by itself by the effect of acceleration of a reciprocating motion of the reciprocating piston.

* * * * *